US010498082B2

(12) United States Patent
Suzuki et al.

(10) Patent No.: US 10,498,082 B2
(45) Date of Patent: Dec. 3, 2019

(54) TERMINAL STRUCTURE THAT SUPPORTS MOVEMENT BETWEEN TWO HOUSINGS

(71) Applicant: IRISO ELECTRONICS CO., LTD., Yokohama-shi, Kanagawa (JP)

(72) Inventors: Hitoshi Suzuki, Yokohama (JP); Hiroaki Kobayashi, Yokohama (JP); Yoshiyuki Ogura, Yokohama (JP); Tomomitsu Saito, Yokohama (JP); Daichi Shimba, Yokohama (JP); Koji Kuniyoshi, Yokohama (JP)

(73) Assignee: IRISO ELECTRONICS CO., LTD., Yokohama-shi, Kanagawa (JP)

( * ) Notice: Subject to any disclaimer, the term of this patent is extended or adjusted under 35 U.S.C. 154(b) by 0 days.

(21) Appl. No.: 16/001,051

(22) Filed: Jun. 6, 2018

(65) Prior Publication Data

US 2018/0351297 A1 Dec. 6, 2018

(30) Foreign Application Priority Data

Jun. 6, 2017 (JP) ..... 2017-111379

(51) Int. Cl.
*H01R 13/631* (2006.01)
*H01R 13/502* (2006.01)
(Continued)

(52) U.S. Cl.
CPC ..... *H01R 13/6315* (2013.01); *H01R 12/716* (2013.01); *H01R 12/91* (2013.01);
(Continued)

(58) Field of Classification Search
CPC ..... H01R 13/6315; H01R 13/533; H01R 13/2492; H01R 13/502; H01R 13/514; H01R 12/91
See application file for complete search history.

(56) References Cited

U.S. PATENT DOCUMENTS 4,738,631 A * 4/1988 Takahashi ..... H01R 13/02 439/246
9,022,801 B2 * 5/2015 Endo ..... H01R 13/533 439/527
(Continued)

FOREIGN PATENT DOCUMENTS

EP 2 806 502 A1 11/2014
JP 1-155672 U 10/1989
(Continued)

OTHER PUBLICATIONS

Office Action dated Aug. 31, 2018, by the Japanese Patent Office in corresponding Japanese Patent Application No. 2017-111379. (5 pages).
(Continued)

*Primary Examiner* — Vanessa Girardi
(74) *Attorney, Agent, or Firm* — Buchanan Ingersoll & Rooney PC

(57) ABSTRACT

There is provided a movable connector that more reliably suppresses pivotal motion of a connection target object at a contact section serving as the center of the pivotal motion. Further, reliable suppression of the pivotal motion of the connection target object at the contact section is achieved with no increase in the size of terminals. A contact section includes a first contact piece section having a first contact section that achieves pressing contact with a pin terminal T in a first direction, a second contact piece section having a second contact section that achieves pressing contact with the pin terminal T in the first direction in a position shifted from the first contact section toward the far side, and a contact receiving section that faces the first and second contact sections and has a contact surface section that comes into contact with the pin terminal T over the length thereof.

12 Claims, 19 Drawing Sheets

(51) Int. Cl.

| | |
|---|---|
| ***H01R 24/60*** | (2011.01) |
| ***H01R 12/71*** | (2011.01) |
| ***H01R 13/187*** | (2006.01) |
| ***H01R 12/91*** | (2011.01) |
| ***H01R 13/24*** | (2006.01) |
| *H01R 13/26* | (2006.01) |

(52) U.S. Cl.
CPC ..... *H01R 13/187* (2013.01); *H01R 13/2492* (2013.01); *H01R 13/502* (2013.01); *H01R 24/60* (2013.01); *H01R 13/26* (2013.01)

(56) References Cited

U.S. PATENT DOCUMENTS

| | | | | |
|---|---|---|---|---|
| 9,997,854 | B2 * | 6/2018 | Kobayashi | H01R 12/91 |
| 10,128,614 | B2 * | 11/2018 | Suzuki | H01R 13/7032 |
| 10,193,260 | B1 * | 1/2019 | Suzuki | H01R 13/10 |
| 2006/0030191 | A1 | 2/2006 | Tuin et al. | |
| 2015/0132998 | A1 | 5/2015 | Sato | |

FOREIGN PATENT DOCUMENTS

| | | | |
|---|---|---|---|
| JP | 1-179385 | U | 12/1989 |
| JP | H03-062466 | U | 6/1991 |
| JP | H06-163125 | A | 6/1994 |
| JP | 2014-165065 | A | 9/2014 |
| JP | 2014-165066 | A | 9/2014 |
| JP | 2015-95405 | A | 5/2015 |
| JP | 2016-181494 | A | 10/2016 |

OTHER PUBLICATIONS

The extended European Search Report dated Oct. 11, 2018, by the European Patent Office in corresponding European Patent Application No. 18176105.7-1201. (9 pages).
Japanese Office Action.

* cited by examiner

TERMINAL STRUCTURE THAT SUPPORTS MOVEMENT BETWEEN TWO HOUSINGS

BACKGROUND OF THE INVENTION

Field of the Invention

The present invention relates to a movable connector.

Description of the Related Art

As a connector that achieves electrically continuous connection between a circuit in a substrate and a connection target object with high connection reliability, there is a known movable connector described, for example, in the paragraph [0030] and FIG. 20 of Japanese Patent Laid-Open No. 2014-165066. The movable connector includes a fixed housing, a movable housing, and terminals that support the movable housing displaceably relative to the fixed housing. The terminals each have a pair of contact pieces 31*a* and 31*b*, which achieves pressing contact with a counterpart terminal 2 as the "connection target object," in such a way that the contact pieces 31*a* and 31*b* sandwich the counterpart terminal 2, as shown in FIG. 20 (Note that the reference characters in FIG. 20 coincide with those in Japanese Patent Laid-Open No. 2014-165066). FIG. 20 further shows that one of the contact pieces or the contact piece 31*a* has two continuous wave-shaped first contact sections 31*a*-1, and that the other contact piece or the contact piece 31*b* has one second contact section 31*b*-1 in the position facing the recess between the two wave shaped contact sections. The movable connector of related art, which includes the thus configured terminals and is so configured that the three contact sections 31*a*-1, 31*a*-1, and 31*b*-1 achieves pressing contact with the counterpart terminal 2 in such a way that the contact sections sandwich the counterpart terminal, suppresses, when the movable housing is displaced, pivotal motion (inclination) of the counterpart terminal 2 at each of the contact sections 31*a*-1, 31*a*-1, and 31*b*-1, which each serve as the center of the pivotal motion, and therefore prevents minute sliding contact between the counterpart terminal 2 and each of the contact sections 31*a*-1 and 31*b*-1. The movable connector therefore has an excellent feature of preventing the minute sliding contact to prevent not only separation of a plated film formed on the surfaces of the contact pieces 31*a*, 31*b* and the counterpart terminal 2 but an increase in electrically conductive resistance due to the separation of the plated films.

The thus configured movable connector of related art can suppress pivotal motion (inclination) of the counterpart terminal 2 at each of the contact sections 31*a*-1, 31*a*-1, and 31*b*-1, which each serve as the center of the pivotal motion. However, since the two contact sections 31*a*-1 are shaped by bending a terminal forming metal plate in the plate thickness direction in such a way that continuous wave-like shapes are formed, it is difficult to form two contact sections 31*a*-1 having the same amount of protrusion in the bending process. If the amount of protrusion varies, the counterpart terminal 2 inclines when the electrically continuous connection is achieved or the counterpart terminal 2 comes into contact with only one of the contact sections 31*a*-1, undesirably resulting in unstable electrically continuous connection.

To prevent the separation of the plated films and other disadvantageous phenomena due to the minute sliding contact described above while allowing a greater displacement of the movable housing, it is required to more reliably suppress the pivotal motion of the counterpart terminal 2. One solution of the requirement is, for example, to employ a method for increasing the inter-contact distance L1 between the upper contact section 31*a*-1 and the lower contact section 31*a*-1 shown in FIG. 20 to increase the inter-contact distance L2 between the lower contact section 31*a*-1 and the second contact section 31*b*-1 and the inter-contact distance L3 between the upper contact section 31*a*-1 and the second contact section 31*b*-1. It is expected that a longer inter-contact distance L2 can suppress by a greater amount the pivotal motion of the counterpart terminal 2 in the counterclockwise direction R1 in FIG. 20, and that a longer inter-contact distance L3 can more reliably suppress by a greater amount the pivotal motion of the counterpart terminal 2 in the clockwise direction R2 in FIG. 20. When the inter-contact distances L1, L2, and L3 are increased as described above, however, the contact piece 31*a* needs to be lengthened along the insertion direction of the counterpart terminal 2, resulting in an increase in the size of the movable connector, which accommodates the contact piece 31*a*, and hence an increase in the footprint of the movable connector on the substrate.

The present invention has been made based on the related art described above. An object of the present invention is to provide a movable connector that more reliably allows suppression of pivotal motion of a connection target object at a contact section serving as the center of the pivotal motion. Another object of the present invention is to achieve reliable suppression of the pivotal motion of the connection target object at the contact section with no increase in the size of terminals.

SUMMARY OF THE INVENTION

To achieve the objects described above, the present invention has the following features:

That is, the present invention relates to a movable connector including a first housing, a second housing including a connection chamber having an insertion port through which a connection target object is inserted, and terminals each having a movable section that supports the second housing in such a way that the second housing is displaceable relative to the first housing and a contact section that achieves electrically continuous contact with the connection target object in the connection chamber, and the contact section includes a first contact piece section having a first contact section that achieves pressing contact with the connection target object in a first direction in a position located in the connection chamber and close to the insertion port, a second contact piece section having a second contact section that achieves pressing contact with the connection target object in the first direction in a position located in the connection chamber and shifted from the first contact section toward a far side, and a contact receiving section that faces the first contact section and the second contact section in the connection chamber and has a contact surface section that comes into contact with the connection target object inserted into the connection chamber along the connection target object.

According to the present invention, the first contact section and the second contact section achieve electrically continuous contact with the connection target object. Therefore, even if one of the contact sections fails to achieve the electrically continuous contact, the other contact section maintains the electrically continuous contact, whereby highly reliable electrically continuous connection can be achieved. Further, the connection target object that receives the pressing contact achieved by the first contact section and the second contact section is pressed against the contact surface, which faces the first contact section and the second contact section, so that the connection target object comes into contact with the contact surface section. At this point, the contact surface section is in contact with the connection target object inserted into the connection chamber along the connection target object without the aid of the plurality of contact sections 31*a*-1 bent in the form of continuous waves in the plate thickness direction, unlike the terminals of the movable connector of related art. No unstable electrically continuous contact with the connection target object resulting from processing precision at the time of manufacture therefore occurs, unlike the movable connector of related art.

The connection target object, which comes into contact with the contact surface section, when the connection target object pivots at the first contact section, which serves as the center of the pivotal motion (center of inclination), comes into contact with the first contact section on the side close to the insertion port of the connection chamber. On the other hand, on the far side in the connection chamber, the connection target object comes into contact with the contact surface section. A long inter-contact distance can thus be provided. More specifically, the position where the connection target object comes into contact with the contact surface section on the far side in the insertion direction can be a farther position in the connection chamber beyond the position where the second contact section comes into contact with the connection target object. Similarly, the connection target object, when it pivots at the second contact section, which serves as the center of the pivotal motion (center of inclination), comes into contact with the contact surface section on the side close to the insertion port of the connection chamber. On the other hand, on the far side in the connection chamber, the connection target object comes into contact with the second contact section. A long inter-contact distance can thus be provided. More specifically, when the connection target object pivots, the position where the connection target object comes into contact with the contact surface section on the side close to the insertion port can be a position close to the insertion port beyond the position where the first contact section comes into contact with the connection target object. Therefore, even in a case where the second housing is displaced relative to the first housing in three-dimensional directions so that the connection target object is likely to be obliquely displaced with respect to the insertion direction, pivotal motion of the connection target object can be more reliably suppressed because the long inter-contact distance is provided. The amount of minute sliding contact of the first contact section and the second contact section with the connection target object can therefore be reduced, whereby occurrence of plated film separation can be avoided. Unlike the related art, in which the inter-contact distances L2 and L3 between the first contact section and the second contact section are increased, that is, the length of the contact piece 31*a* is increased, the inter-contact distance between the first contact section and the contact surface section, and the inter-contact distance between the second contact section and the contact surface section can be increased to suppress the pivotal motion of the connection target object, whereby an increase in the size of the contact section can be suppressed.

The contact receiving section can be configured to have a fixing section fixed to the second housing, the fixing section located at a front end portion located in a position close to the insertion port.

For example, in a movable connector in which the front end portion of the contact receiving section is not fixed and which is a movable connector compared with the movable connector according to the present invention, the front end portion is separate from the inner wall of the connection chamber of the second housing or operates in a floating state, so that when the connection target object is inserted via the insertion port, the connection target object could collide with the front end portion, resulting in buckling of the front end portion. On the other hand, according to the present invention, the contact receiving section has the fixing section, which is formed at a front end portion located in a position close to the insertion port in the connection chamber of the second housing and fixed to the second housing. The contact receiving section can therefore be reliably so fixed along the inner wall of the connection chamber as not to protrude into the connection chamber in a position close to the insertion port, whereby a situation in which the connection target object comes into contact with the front end portion of the contact receiving section to cause buckling of the contact receiving section can be avoided, unlike the movable connector described above compared with the movable connector according to the present invention.

The first contact piece section and the second contact piece section can be configured as spring pieces displaceable independently of each other.

According to the present invention, the first contact piece section and the second contact piece section, which are displaced independently of each other, can each come into contact with the connection target object independently of the other without affecting the contact pressure, the contact position, and other contact states of the other with respect to the connection target object.

The contact surface section can be so shaped as to protrude toward the first contact section and the second contact section.

In the present invention, the contact surface section protrudes toward the connection target object, and the contact receiving section has a protruding portion (contact surface section) and a non-protruding portion (general surface section). Since the connection target object comes into contact with the contact surface section, which is the protruding portion, over the length of the contact surface section in the insertion direction of the connection target object, the contact length (effective fitting length) in contact with the connection target object can be the fixed a length of the contact surface section along the insertion direction. The contact surface section can be configured as a protrusion that protrudes in the form of a bead toward the first contact section and the second contact section by way of example. As another example, the contact surface section can be configured as a protruding surface section, in which at least the contact receiving section, which faces the first contact section and the second contact section protrudes toward the first contact section and the second contact section. In the case where the contact surface section is the protrusion, it is easy to reduce the contact area in contact with the connection target object and increase the contact pressure, whereby occurrence of the minute sliding contact can be more reliably suppressed. In the case where the contact surface section is the protruding surface section, the contact area in contact with the connection target object is wider than in the case where the contact surface section is the protrusion, whereby more reliable electrically continuous contact can be achieved even when the contact attitude of the connection target object changes.

The second contact piece section can be configured to have a second elastic arm that supports the second contact section in such a way that the second contact section is displaceable relative to the contact receiving section.

According to the present invention, the second elastic arm is linked to the contact receiving section, which faces the first contact piece section, and displaceably supports the second contact section. The size of the second contact piece section can therefore be reduced as compared with a case where the second contact piece section is so formed as to extend from the same contact section from which the first contact piece section extends, whereby the size of the second contact piece section can be reduced while employing the terminal structure having two contact piece sections, and the size of the movable connector can also be reduced.

The second elastic arm can be so shaped as to link opposing plate edges of the second contact section and the contact receiving section to each other.

According to the present invention, the second contact section achieves pressing contact with the connection target object in the first direction, in which the first contact section achieves pressing contact with the connection target object. Since the second elastic arm, which supports the second contact section, extends from the plate edge of the contact receiving section, which faces the first contact piece section, so that the size of the second contact piece section can be reduced, whereby the size of the contact section can be reduced while employing the terminal structure having two contact piece sections, and the size of the movable connector can also be reduced.

The first contact section can be configured to protrude beyond the second contact section in the direction in which the first contact section achieves pressing contact with the connection target object.

According to the present invention, since the first contact section, which is located in a position close to the insertion port of the connection chamber, protrudes beyond the second contact section in the direction in which the first contact section achieves pressing contact with the connection target object, the second contact section can press the connection target object so that the second contact section can achieve pressing contact with the connection target object in a state in which the pressing contact between the connection target object and the first contact section achieves an appropriate insertion attitude of the connection target object, whereby buckling deformation of the second contact section can be avoided.

The second contact section can be configured to have a guiding inclining surface that guides the insertion of the connection target object, the guiding inclining surface located at a front end portion close to the insertion port.

According to the present invention, the guiding inclining surface is formed at the front end portion of the second contact section. Therefore, if the connection target object is obliquely inserted and further accidentally inserted along the rear side of the second contact section or the side opposite the contact surface of the second contact section, deformation of the second contact piece section and other types of inconvenience can be avoided.

The first contact section can be configured to have a convexly bent shape located in a position closer to the insertion port than the second contact section.

According to the present invention, the second contact section can be disposed in a dead space on the far side of the first contact section, which has a convexly bent shape, in the connection chamber, the size of the contact section can be reduced, and the size of the movable connector can also be reduced.

The first contact piece section can be configured to have a clearance recess section that avoids contact with the second contact section displaced toward the first contact piece section when the second contact section receives the pressing contact produced by the connection target object.

According to the present invention, the first contact piece section has the clearance recess section. The second contact section, when it is displaced by the pressing contact produced by the connection target object, therefore does not come into contact with first contact piece section. The first contact piece section and the second contact section can therefore be so disposed as to approach each other, as compared with a case where the first contact piece section is provided with no clearance recess section, whereby the entire size of the contact section can be reduced, and the size of the movable connector can also be reduced.

Since the connector according to the present invention has an electrically continuous contact structure in which the connection target object is sandwiched between the first and second contact sections and the contact surface section, which comes into contact with the connection target object over the length thereof, pivotal motion of the connection target object at the first contact section and the second contact section can be more reliably suppressed than in the case of a movable connector of related art. The connector according to the present invention, which is a movable connector, can therefore reduce the amount of minute sliding contact between the first and second contact sections and the connection target object to suppress plated film separation and realize excellent contact reliability and electrical continuity.

Further, unlike a movable connector of related art having a terminal structure in which one contact piece has a plurality of contact sections continuously formed in the form of waves, the connector according to the present invention has a terminal structure in which the first contact piece section and the second contact piece section are separately provided and the first and second contact sections thereof and the contact surface section come into contact with the connection target object, the inter-contact distances between the first and second contact sections and the contact surface section can be increased with no increase in the size of the terminals, whereby the sizes of the terminals and the movable connector can be reduced.

DETAILED DESCRIPTION OF THE PREFERRED EMBODIMENTS

Embodiments of a movable connector according to the present invention will be described below with reference to the drawings. In the scope of the present specification and claims, the width direction or the rightward/leftward direction of the movable connector is a direction X, the depth direction or the frontward/rearward direction thereof is a direction Y, and the height direction or the upward/downward direction thereof is a direction Z for ease of description, but the definition of the directions is not intended to limit a method for mounting the movable connector or a method for using the movable connector.

First Embodiment [FIGS. 1 to 10]

Figure 9:
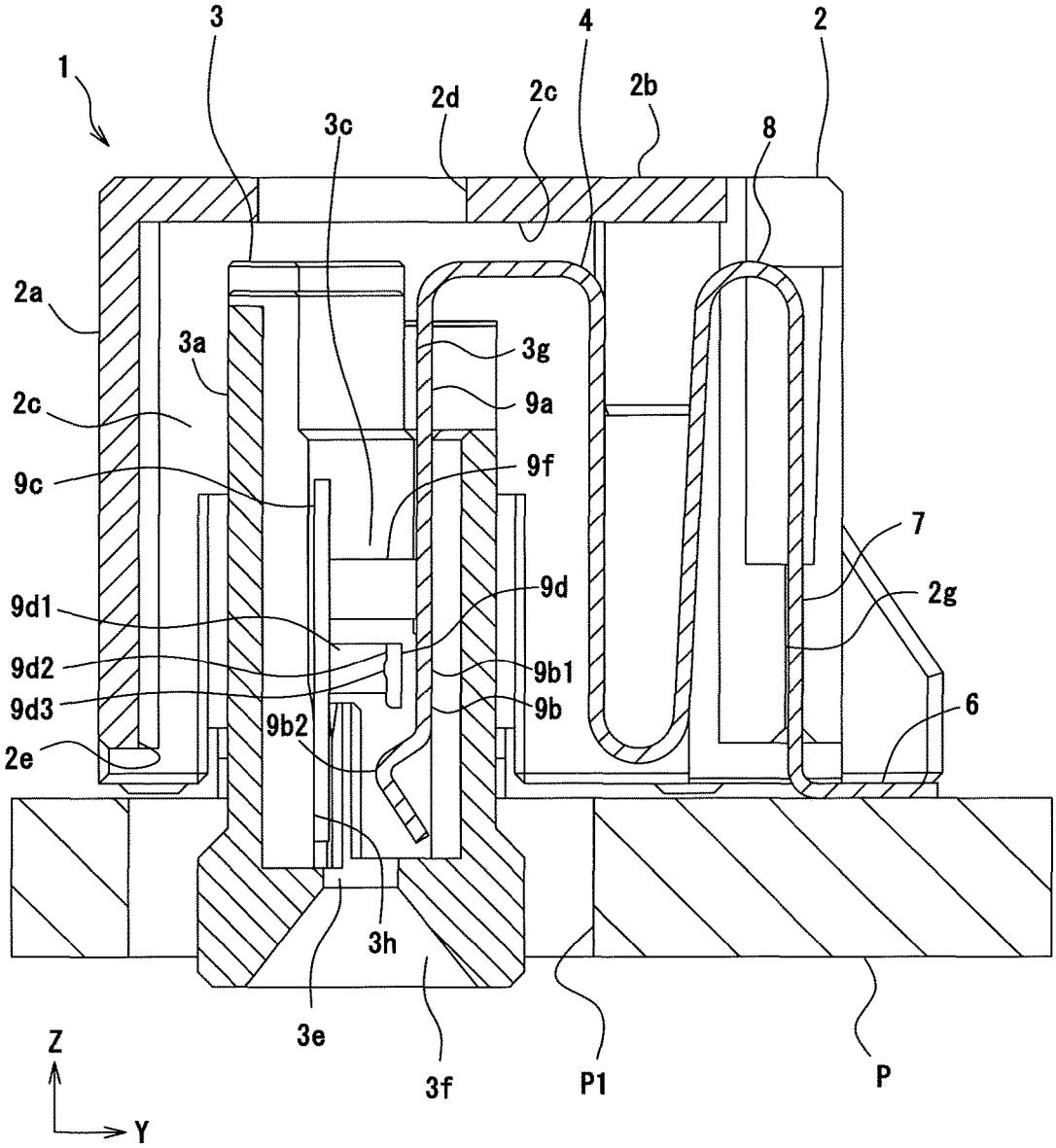
FIG. 9 is a cross-sectional view taken along the line IX-IX in FIG. 2.
Figure 10:
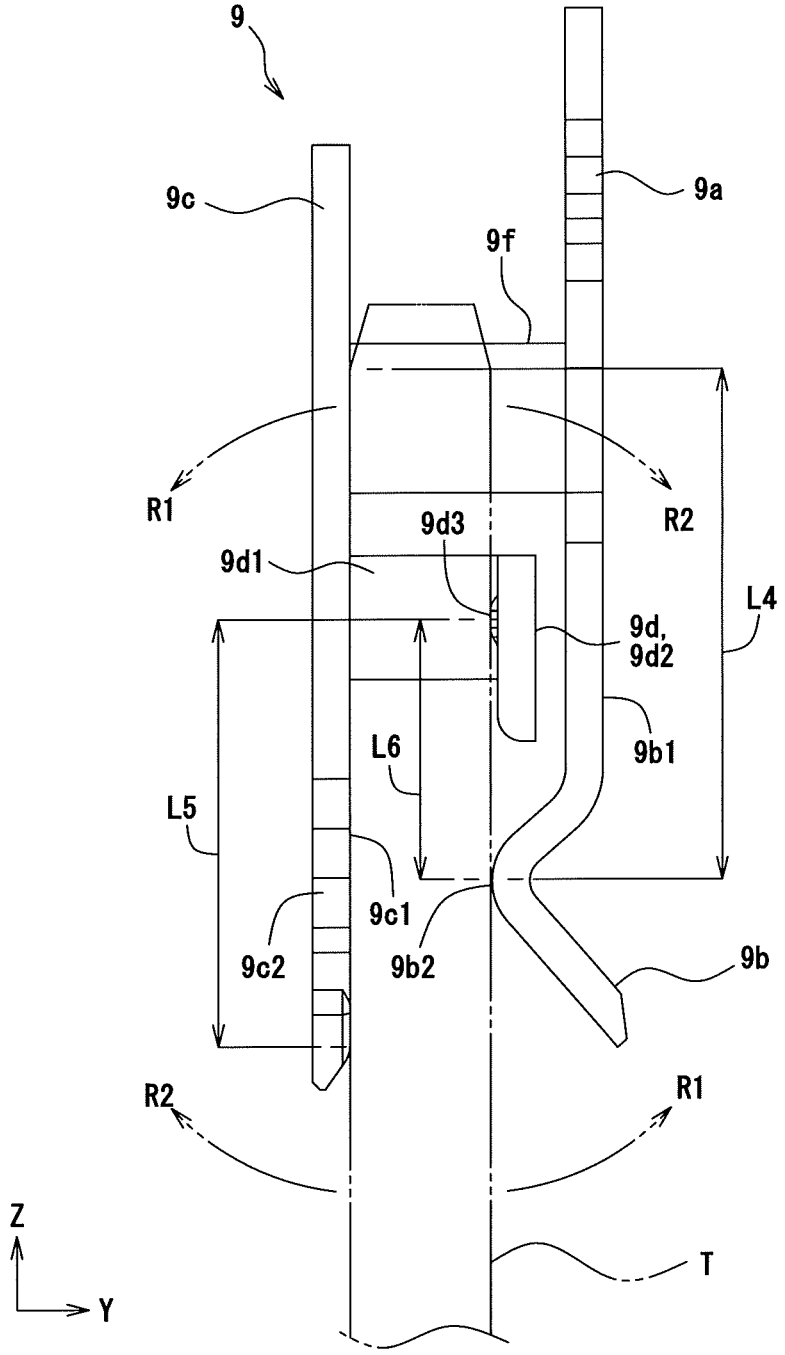
FIG. 10 describes the action of the terminal shown in FIG. 6.

A movable connector 1 includes a fixed housing 2 as a "first housing," a movable housing 3 as a "second housing," a plurality of terminals 4, and a plurality of fixtures 5, which fix the fixed housing 2 to a substrate P. The movable connector 1 is configured as a bottom-entry connector which is mounted on one surface of the substrate P and into which pin terminals T as the "connection target object" are inserted via the other surface of the substrate P for electrically continuous connection (FIGS. 9 and 10).

[Fixed Housing 2]

Figure 1:
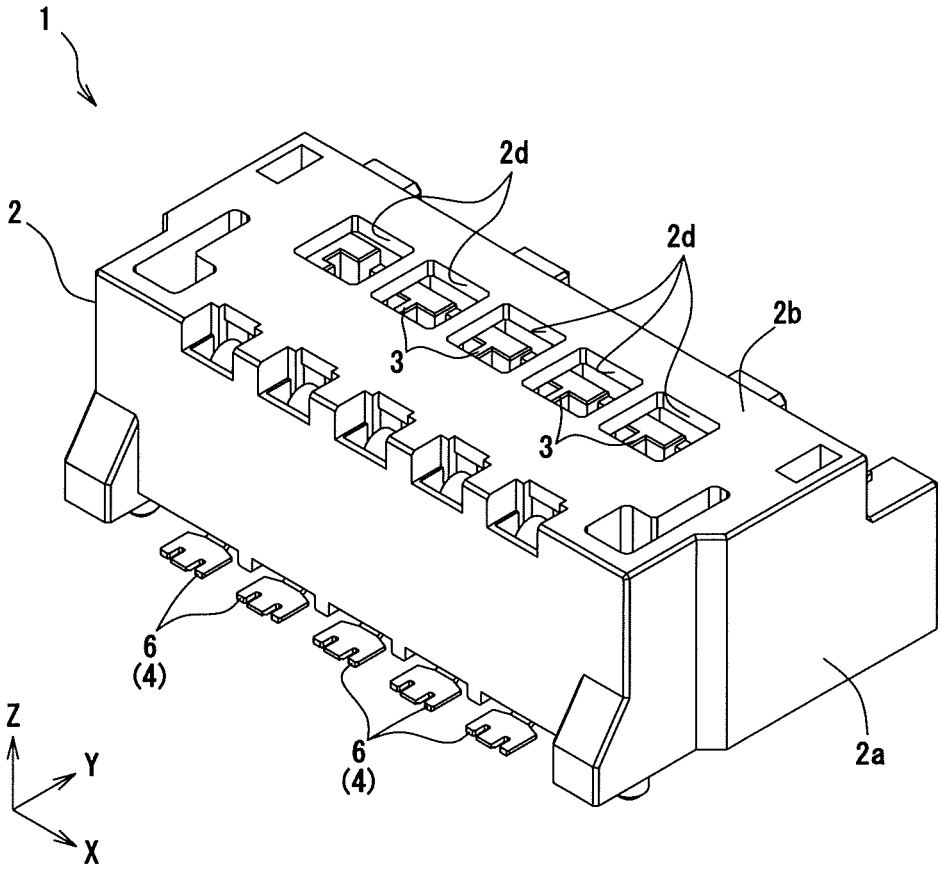
FIG. 1 is an exterior perspective view including the front surface, the right side surface, and the plan surface of a movable connector according to a first embodiment.
Figure 2:
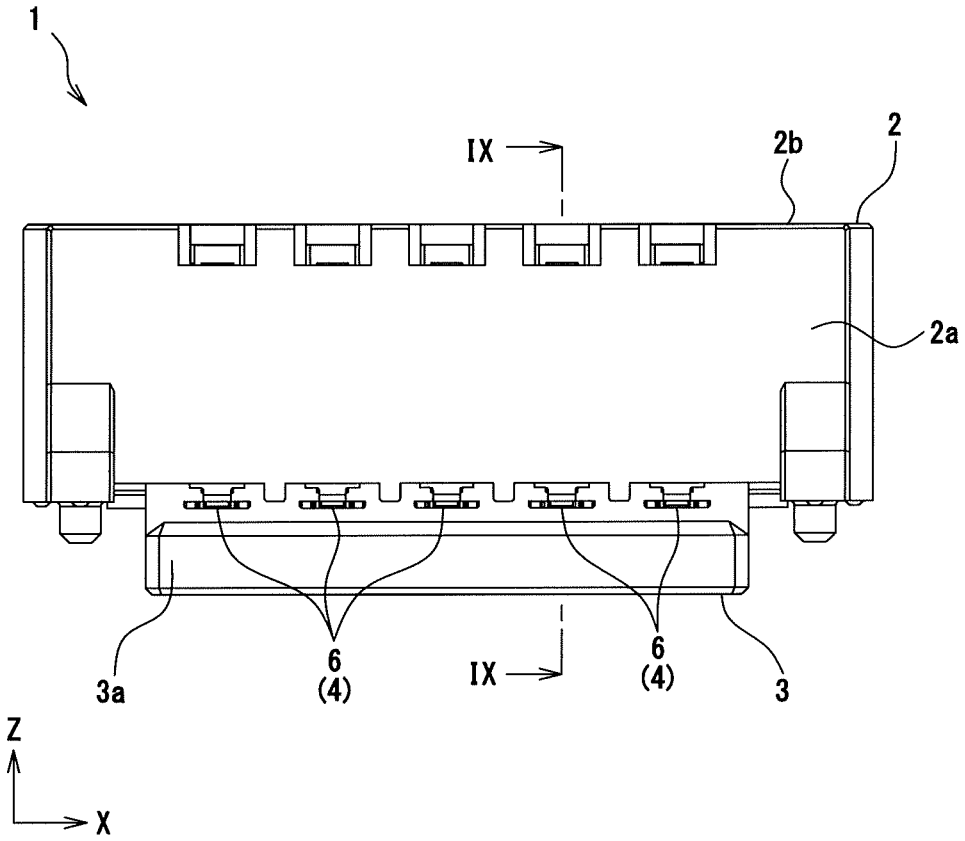
FIG. 2 is a front view of the movable connector shown in FIG. 1.
Figure 3:
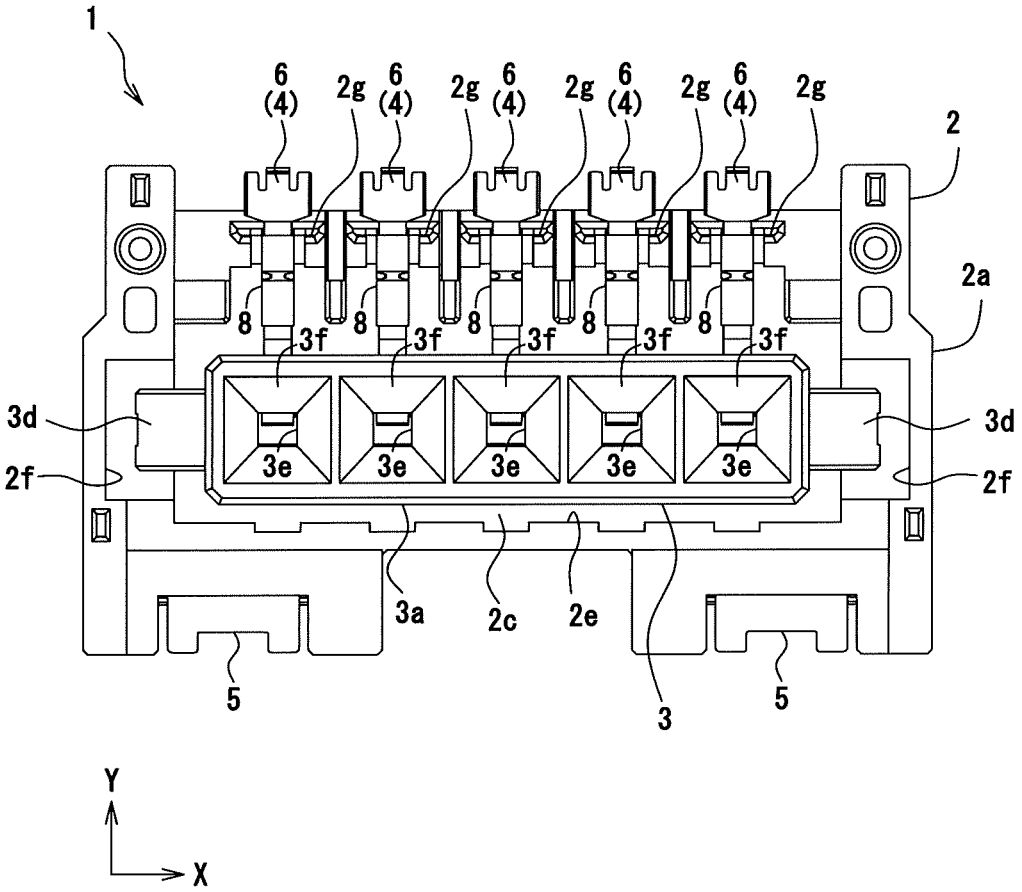
FIG. 3 is a bottom view of the movable connector shown in FIG. 1.
Figure 4:
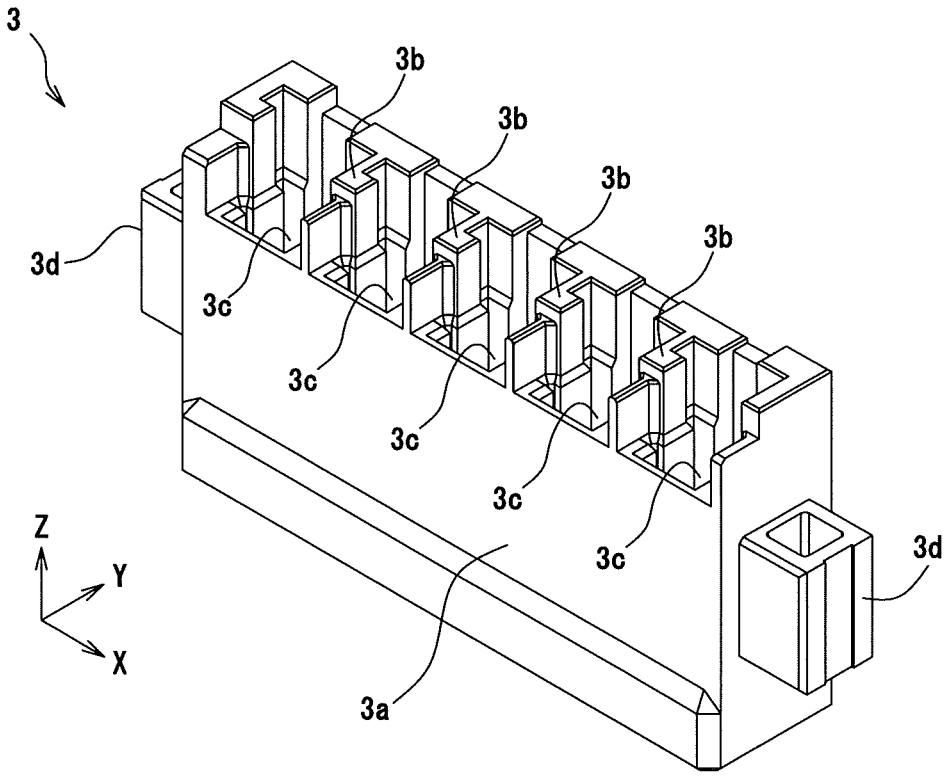
FIG. 4 is an exterior perspective view including the front surface, the right side surface, and the plan surface of a movable housing provided in the movable connector shown in FIG. 1.
Figure 5:
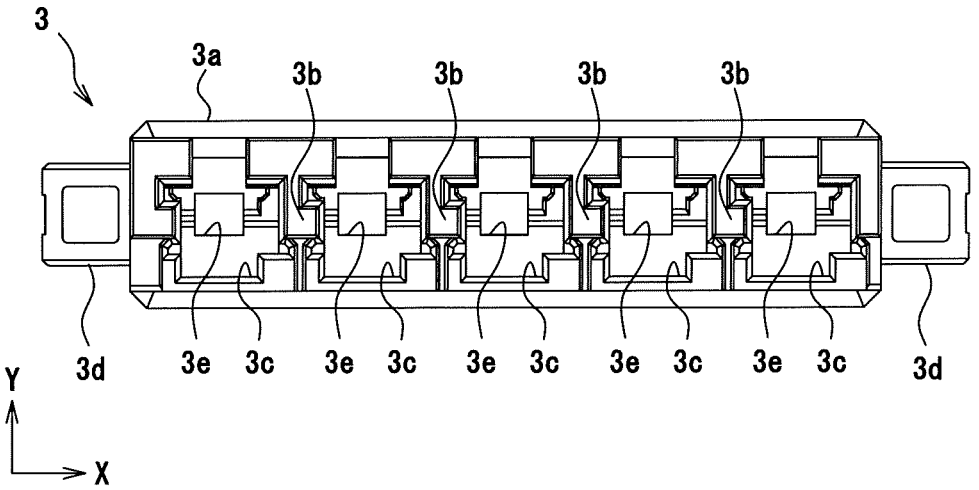
FIG. 5 is a plan view of the movable housing shown in FIG. 3.

The fixed housing 2 is formed of a resin molded body and has an outer circumferential wall 2*a* and a top wall 2*b*. The outer circumferential wall 2*a* is formed in a rectangular tubular shape, and an accommodation chamber 2*c*, which accommodates the movable housing 3, is formed inside the outer circumferential wall 2*a* and the top wall 2*b* (FIGS. 3 and 9). The movable housing 3 is so held by the plurality of terminals 4 as to be displaceable in three-dimensional directions in the in-chamber space of the accommodation chamber 2*c*. The fixtures 5 described above are press-fitted and fixed to the rear surface of the outer circumferential wall 2*a* of the fixed housing 2 and in opposite positions in the width direction X (FIG. 3). A plurality of top openings 2*d*, which allow visual recognition of the state of connection between the pin terminals T and the terminals 4, are formed in the top wall 2*b* of the fixed housing 2 (FIGS. 1 and 9). In the present embodiment, five top openings 2*d* are arranged in a single row along the width direction X. The top openings 2*d* also function as heat dissipating windows for dissipating heat generated in the pin terminals T and the terminals 4 when current flows therethrough out of the fixed housing 2. A bottom opening 2*e* is formed in the bottom surface of the fixed housing 2, and the movable housing 3 is inserted through the bottom opening 2*e* into the accommodation chamber 2*c*.

[Movable Housing 3]

The movable housing 3 is formed of a resin molded body so sized in the width direction X and the depth direction Y as to be accommodated in the accommodation chamber 2*c* of the fixed housing 2 and has an outer circumferential wall 3*a* and a plurality of partition walls 3*b*, which divide the interior of the outer circumferential wall 3*a* into a plurality of spaces. The outer circumferential wall 3*a* is formed in a rectangular tubular shape, and inner spaces surrounded by the outer circumferential wall 3*a* and the partition walls 3*b* are configured as a plurality of connection chambers 3*c*, where the terminals 4 achieve electrically continuous connection with the pin terminals T. In the present embodiment, five connection chambers 3*c* are arranged in a single row along the width direction X. Contact sections 9 of the terminals 4, which will be described later, are fixed in the connection chambers 3*c*. Displacement restricting protrusions 3*d* are so formed as to protrude from the opposite side surface, in the width direction X, of the outer circumferential wall 3*a*. The displacement restricting protrusions 3*d* are so disposed as to protrude into displacement restricting recesses 2*f*, which are formed on opposite sides, in the width direction X, of the accommodation chamber 2*c* of the fixed housing 2 described above (FIG. 3). The movable housing 3 is displaceable until the displacement restricting protrusions 3*d* abut against the displacement restricting recesses 2*f* in the rightward/leftward direction X, the frontward/rearward direction Y, and the height direction Z (only upward). The downward displacement in the height direction Z is restricted when the displacement restricting protrusions 3*d* abut against the substrate P. A lower end portion of the movable housing 3 has been inserted through a through hole P1 of the substrate P and protrudes beyond the rear surface of the substrate P (FIG. 9). Insertion ports 3*e*, through which the pin terminals T are inserted, are formed in the bottom surface of the movable housing 3. The insertion ports 3*e* each have a funnel-shaped guiding inclining surface 3*f*, and the pin terminals T are guided along the guiding inclining surfaces 3*f* and inserted via the insertion ports 3*e* into connection chambers 3*c*.

[Terminals 4]

The terminals 4 each include a substrate fixing section 6, a fixed housing fixing section 7, which is press-fitted and fixed to the fixed housing 2, a movable section 8, which supports the movable housing 3 in such a way that the movable housing 3 is displaceable relative to the fixed housing 2, and a contact section 9, which is accommodated in the corresponding connection chamber 3*c* of the movable housing 3 and achieves electrically continuous connection with the corresponding pin terminal T. The functional portions and the shape of each of the terminals 4 are achieved and formed by bending a punched electrically conductive metal piece and integrated with one another. That is, the terminals 4 are each formed as a single part.

The substrate fixing section 6 protrudes frontward beyond the front surface of the fixed housing 2 and is soldered to the substrate P. The fixed housing 2 is fixed by the substrate fixing sections 6 on the front side of the fixed housing 2 and fixed by the fixtures 5 in a soldering process on the rear side of the fixed housing 2, whereby the fixed housing 2 can reliably accept the force produced when the plurality of pin terminals T are inserted via the rear surface of the substrate P.

Figure 6:
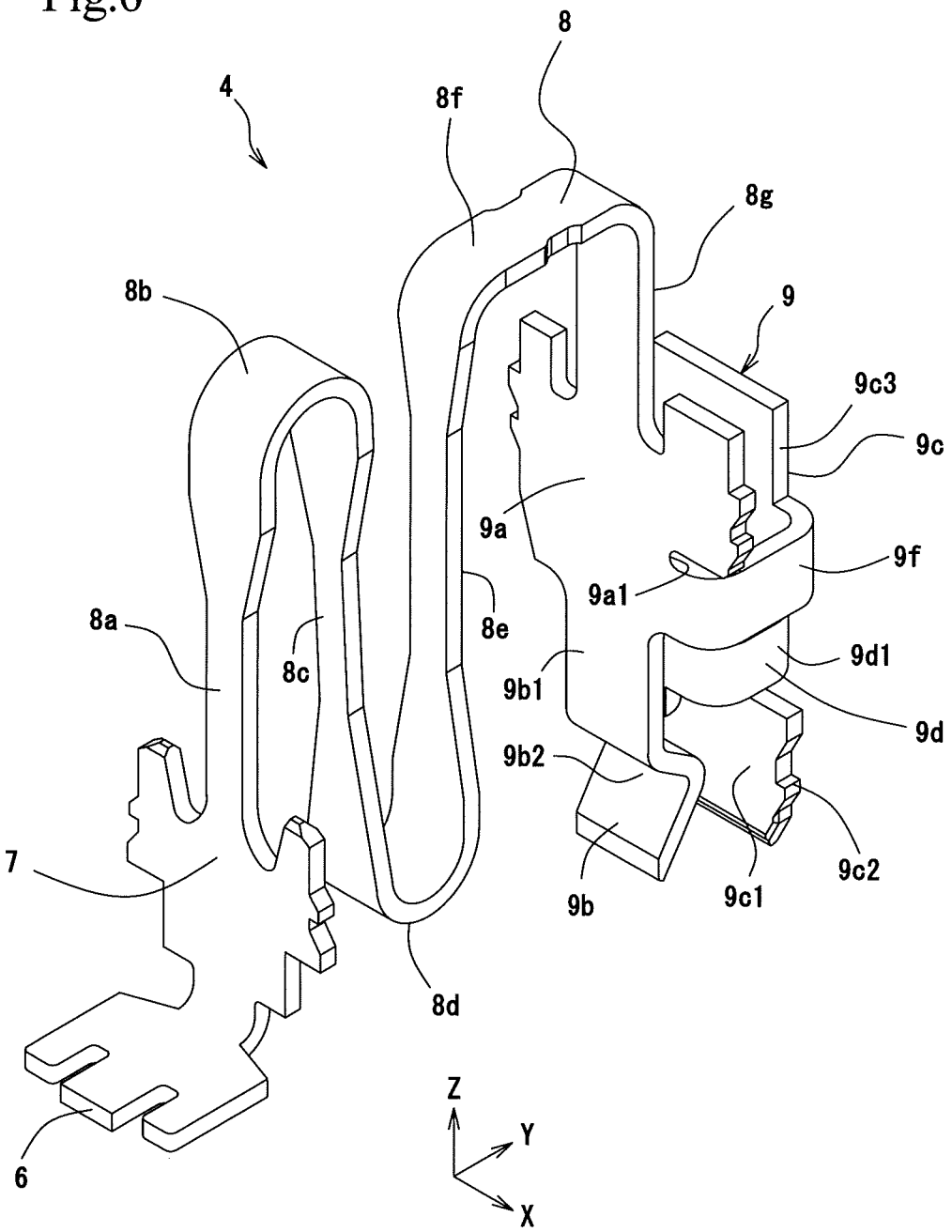
FIG. 6 is an exterior perspective view including the front surface, the right side surface, and the plan surface of a terminal provided in the movable connector shown in FIG. 1.
Figure 7:
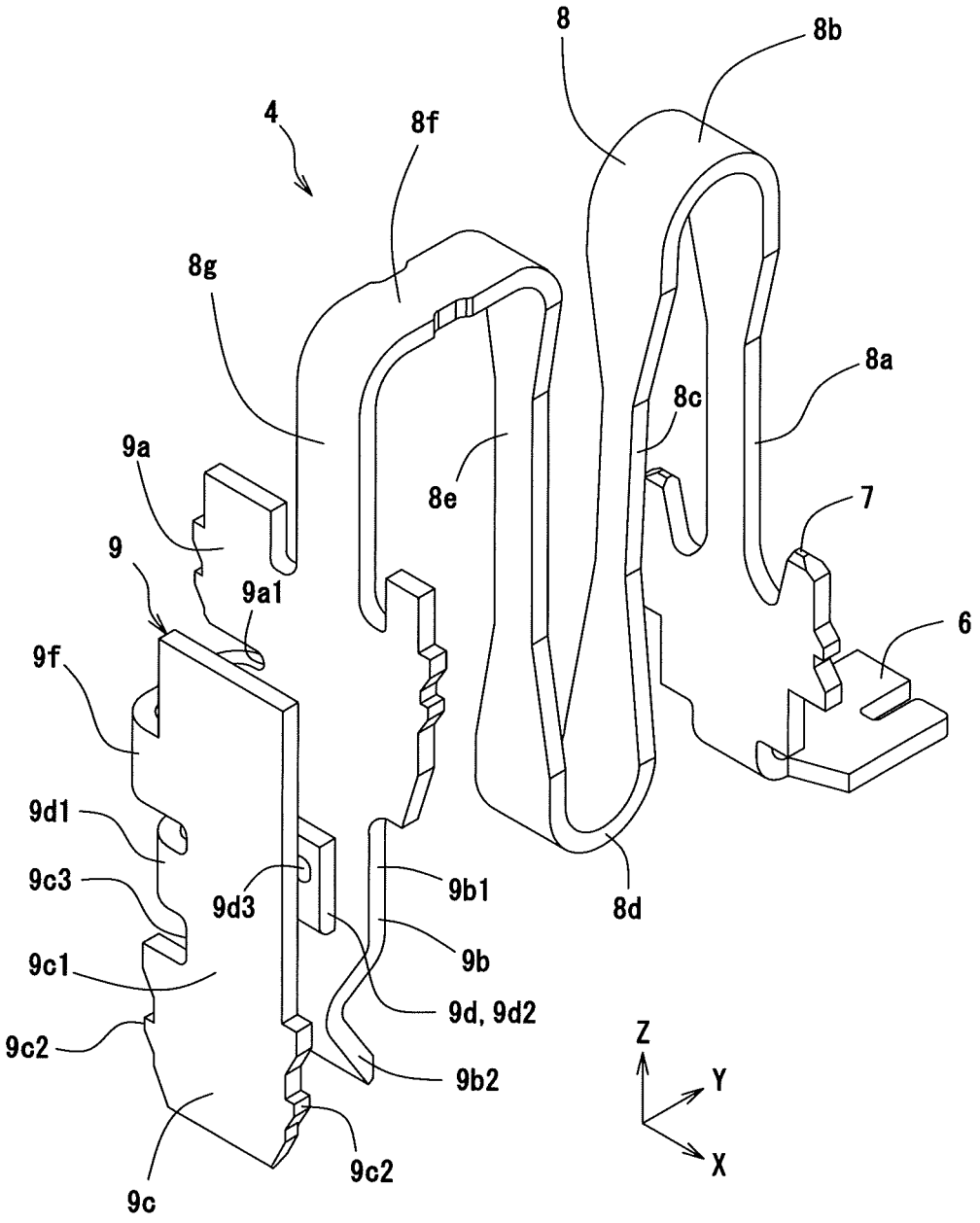
FIG. 7 is an exterior perspective view including the rear surface, the left side surface, and the plan surface of the terminal shown in FIG. 6.
Figure 8:
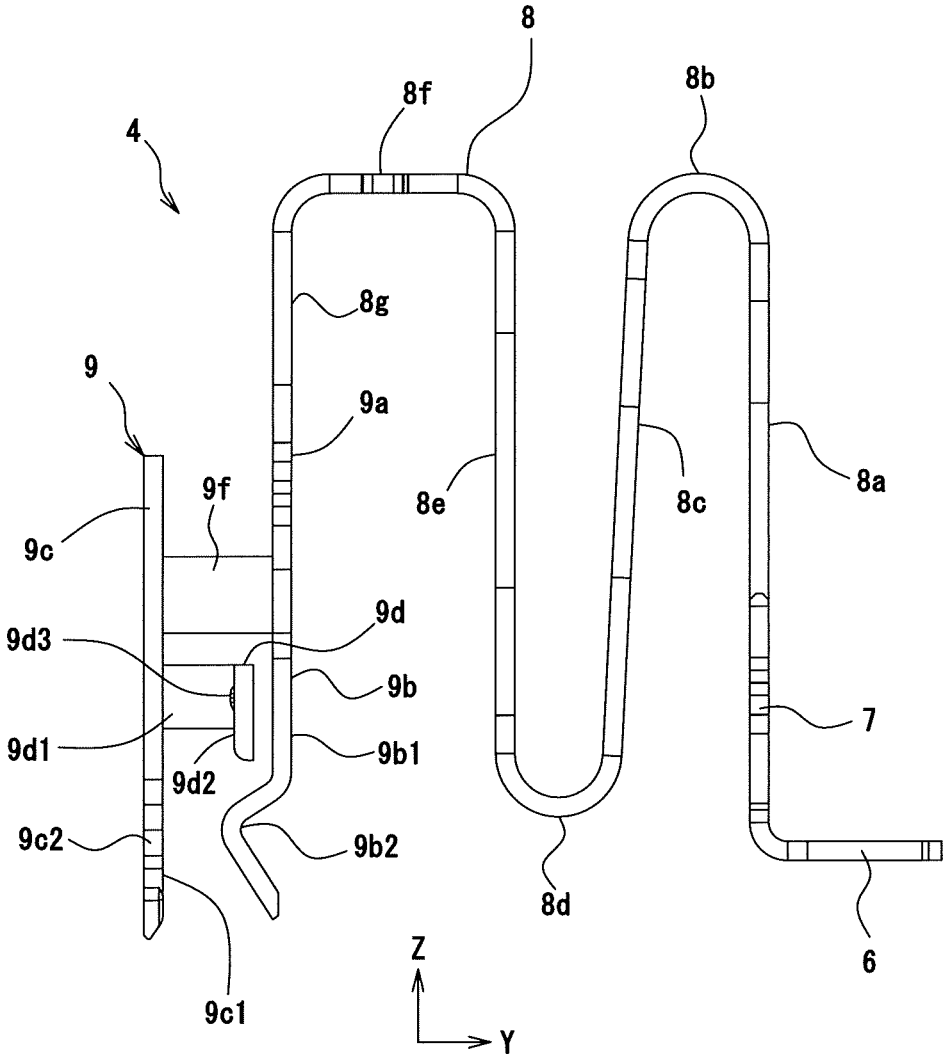
FIG. 8 is a left side view of the terminal shown in FIG. 6.

The fixed housing fixing section 7 is press-fitted and fixed to the corresponding one of terminal fixing grooves 2*g*, which are provided in the accommodation chamber 2*c* of the fixed housing 2 (FIGS. 3 and 9). The movable section 8 has a first extending section 8*a*, which extends upward from the fixed housing fixing section 7, a first bent section 8*b*, which is folded back at the upper end of the first extending section 8*a*, a second extending section 8*c*, which extends from the first bent section 8*b* in parallel to the first extending section 8*a*, a second bent section 8*d*, which is folded back at the lower end of the second extending section 8*c*, a third extending section 8*e*, which extends from the second bent section 8*d* in parallel to the second extending section 8*c*, a third bent section 8*f*, which is folded back at the upper end of the third extending section 8*e*, and a fourth extending section 8*g*, which is linked to a fixed base section 9*a*, which will be described later, as shown in FIGS. 6 to 8. The first extending section 8*a*, the second extending section 8*c*, and the third extending section 8*e* are so each formed that the plate width thereof along the direction X gradually decreases with distance from the side where the extending section is linked to the first bent section 8*b*, the second bent section 8*d*, or the third bent section 8*f*, whereby the extending section can achieve softness as a spring. Further, the movable section 8 has a long spring length because three longitudinal spring pieces (first extending section 8*a*, second extending section 8*c*, and third extending section 8*e*) that extend in the upward/downward direction (direction Z) are arranged in parallel to one another. The third extending section 8*e* may be omitted if the movable section 8 only needs to be displaceable in the frontward/rearward direction Y. However, the three longitudinal spring pieces disposed in parallel to one another as described above not only allow the movable housing 3, which is particularly displaced in the frontward/rearward direction Y, to be so elastically supported that the movable housing 3 can be flexibly displaced but increase durability as a spring.

The contact section 9 has a fixed base section 9*a*, which is linked to the fourth extending section 8*g* of the movable section 8 and fixed to the movable housing 3, a first contact piece section 9*b*, which extends from the fixed base section 9*a* in the form of a cantilever, a contact receiving section 9*c*, which faces the first contact piece section 9*b*, a second contact piece section 9*d*, which extends from the contact receiving section 9*c* in the form of a cantilever, and a linkage section 9*f*, which links the fixed base section 9*a* to the contact receiving section 9*c*, as shown in FIGS. 6 to 8.

The fixed base section 9*a* is press-fitted and fixed to the corresponding one of first terminal fixing grooves 3*g*, which are provided in the movable housing 3, as shown in FIG. 9.

The first contact piece section 9*b* has a first elastic arm 9*b*1, which extends from the fixed base section 9*a*, and a first contact section 9*b*2, which is displaceably supported by the first elastic arm 9*b*1 and achieves pressing contact with the corresponding pin terminal T, which is the connection target object, in a "first direction," that is, from the front side toward the rear side in the frontward/rearward direction Y. The first contact section 9*b*2 is so formed as to protrude in a convexly bent shape toward the contact receiving section 9*c*.

The contact receiving section 9*c* is formed as a flat-plate-shaped metal piece as a whole, and a surface of the contact receiving section 9*c* or the surface facing the first contact piece section 9*b* is formed as a flat contact surface section 9*c*1, which extends along the insertion direction of the pin terminals T (direction Z). The contact surface section 9*c*1, which is a portion that comes into contact with the corresponding pin terminal T, is so formed as to be longer than at least the inter-contact distance between the first contact section 9*b*2 and a second contact section 9*d*2 (contact 9*d*3). An end portion of the contact receiving section 9*c* or the end portion facing the first contact section 9*b*2 has fixing sections 9*c*2, which are press-fitted and fixed to the corresponding one of second terminal fixing grooves 3*h* of the movable housing 3, as shown in FIG. 9. The contact receiving section 9*c* itself is therefore press-fitted and fixed to the movable housing 3 independently of the other sections of the contact section 9. The contact surface section 9*c*1 is so disposed as to be exposed to the corresponding connection chamber 3*c* of the movable housing 3 except the fixing sections 9*c*2, which are press-fitted and fixed to the second terminal fixing groove 3*h*. The reason for this is that the contact surface section 9*c*1 receives sliding contact provided by the pin terminal T inserted into the connection chamber 3*c* and achieves electrically continuous connection with the pin terminal T in the fitting state. A surface of the contact receiving section 9*c* or the surface opposite the contact surface section 9*c*1 is in contact with the resin wall of the movable housing 3, and the pressing force received from the pin terminal T is accepted by the resin wall via the contact receiving section 9*c*.

The second contact piece section 9*d* has a second elastic arm 9*d*1 and the second contact section 9*d*2, as shown in FIGS. 8 and 10. The second elastic arm 9*d*1 has a base end linked to one of plate edges 9*c*3 (right plate edge) of the contact receiving section 9*c* (FIGS. 6 and 7), bends from the plate edge 9*c*3, and extends toward the first contact piece section 9*b*. More specifically, the front end of the second elastic arm 9*d*1 extends to a position above the first contact section 9*b*2, which has a convexly bent shape, and adjacent to the first elastic arm 9*b*1, as shown in FIG. 8, and the front end is linked to the second contact section 9*d*2, which is formed of a plate piece parallel to the plate surface of the first elastic arm 9*b*1, via a bent portion. Therefore, the second contact section 9*d*2, when viewed in the insertion direction Z of the pin terminals T, is so disposed as to be hidden behind the first contact section 9*b*2, which has a convexly bent shape. The second contact section 9*d*2 is formed in a plate-like shape, and a surface of the second contact section 9*d*2 or the surface facing the contact receiving section 9*c* has the contact 9*d*3, which achieves pressing contact with the pin terminal T.

The linkage section 9*f* has one end linked to one of plate edges 9*a*1 (right plate edge) of the fixed base section 9*a* (FIGS. 6 and 7) and the other end formed as a spring piece linked to the right plate edge 9*c*3 of the contact receiving section 9*c*. The linkage section 9*f* and the second elastic arm 9*d*1 are therefore disposed side by side in the direction Z. The contact receiving section 9*c* is fixed to the movable housing 3 via the fixing sections 9*c*2 on the front end side (lower end side), and the contact receiving section 9*c* is further fixed to the movable housing 3 via the linkage section 9*f* and the fixed base section 9*a* on the opposite side (upper end side) because the other end of the linkage section 9*f* is linked to the contact receiving section 9*c*. Therefore, the contact receiving section 9*c* is reliably fixed to the movable housing 3 and can accept the contact provided by the pin terminal T when the contact receiving section 9*c* is in contact with the pin terminal T along the length thereof.

[Advantageous Effects of Movable Connector 1]

Advantageous effects of the thus configured movable connector 1 will next be described.

The movable connector 1 is so configured that the movable housing 3 is so supported by the movable sections 8 of the terminals 4 as to be displaceable relative to the fixed housing 2 in the three-dimensional directions (direction X, direction Y, direction Z, and combination thereof). Therefore, in the fitting connection of the pin terminals T, a shift in the insertion position of the pin terminals T can be absorbed by displacement of the movable housing 3 for adequate fitting connection. In the fitting connection state in which the pin terminals T are located in the proper contact position and achieve electrically continuous connection, when the pin terminals T or the substrate P is displaced due to vibration or impact, the vibration or any other external factor can be absorbed by displacement of the movable housing 3. Further, in the fitting connection state, both the first contact section 9*b*2 and the second contact section 9*d*2 achieve electrically continuous contact with a pin terminal T wile pressing the pin terminal T. Therefore, even if one of the contact sections fails to achieve the electrically continuous contact, the other contact section maintains the electrically continuous contact, whereby highly reliable electrically continuous connection can be achieved.

Figure 20:
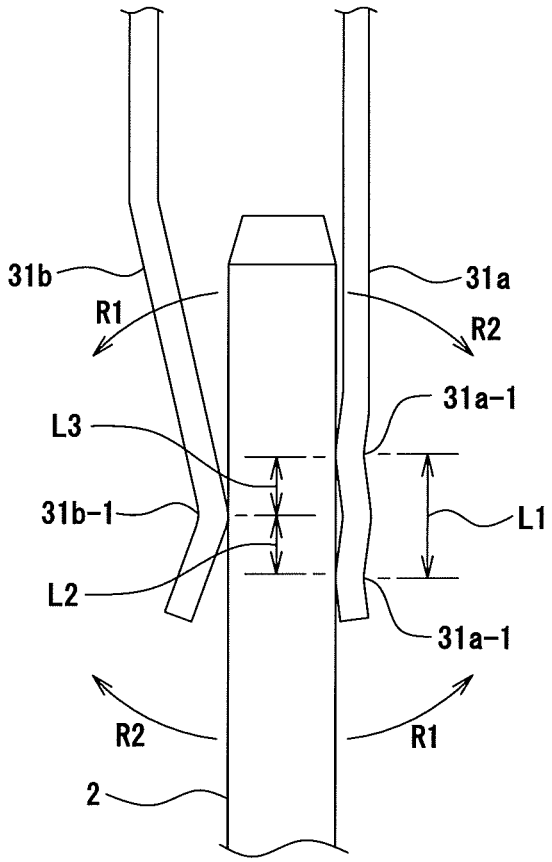
Fig.20 Prior Art
FIG. 20 describes the action of a terminal provided in a movable connector of an example of related art.

In addition to the basic advantageous effect described above, the movable connector 1 has the following features: A pin terminal T is so pressed by the first contact section 9*b*2 and the second contact section 9*d*2 as to come into contact therewith, and the pin terminal T comes into contact with the flat contact surface section 9*c*1 of the contact receiving section 9*c* in the pressing contact direction (direction Y). Unlike the movable connector of related art shown in FIG. 20, in which the plurality of contact sections 31*a*-1 are bent in the form of continuous waves in the plate thickness direction, the contact surface section 9*c*1 has a flat surface shape that comes into contact with a pin terminal T along the length of the pin terminal T in accordance with the length of the inserted pin terminal T, resulting in no unstable electrically continuous contact with the pin terminal T resulting from processing precision at the time of manufacture, unlike the movable connector of related art. The movable connector 1 can therefore more reliably suppress pivotal motion (inclination) of the pin terminal T at the first contact section 9*b*2 and the second contact section 9*d*2 (contact protrusion 9*d*3), which each serve as the center of the pivotal motion.

In the movable connector 1, the pin terminal T, when it pivots in the counterclockwise direction R1, comes into contact with the first contact section 9*b*2 on the side close to the insertion port 3*e* of the connection chamber 3*c*, as shown in FIG. 10. On the other hand, on the far side in the connection chamber 3*c*, the insertion-side end portion of the pin terminal T comes into contact with the contact surface section 9*c*1. A long inter-contact distance L4 can thus be provided and reduce the effect of the pivotal motion of the pin terminal T in the counterclockwise direction R1, whereby even slight pivotal motion can be reliably handled. The pin terminal T tries to pivot around the point where the pin terminal T is in contact with the non-displacing contact surface section 9*c*1, but the pivotal motion is not allowed not only by the first contact piece section 9*b* but the second contact piece section 9*d*, which is located between the pin terminal T and the first contact piece section 9*b*. The two contact piece sections, the first contact piece section 9*b* and the second contact piece section 9*d*, can thus more reliably suppress the pivotal motion of the pin terminal T in the counterclockwise direction R1, whereby occurrence of plated film separation due to the minute sliding contact and other undesirably phenomena can be avoided.

Similarly, the pin terminal T, when it pivots in the clockwise direction R2, comes into contact with the second contact section 9*d*2 (contact protrusion 9*d*3) on the far side in the connection chamber 3*c*. On the other hand, on the side close to the insertion port 3*e* of the connection chamber 3*c*, the lower end of the flat contact surface section 9*c*1 comes into contact with the pin terminal T. A long inter-contact distance L5 can thus be provided and reduce the effect of the pivotal motion of the pin terminal T in the clockwise direction R2, whereby even slight pivotal motion can be reliably handled. The pin terminal T tries to pivot around the point where the pin terminal T is in contact with the lower end of the non-displacing contact surface section 9*c*1, but the pivotal motion is not allowed not only by the second contact piece section 9*d* but the first contact piece section 9*b*, which is located between the pin terminal T and the second contact piece section 9*d*. The two contact piece sections, the first contact piece section 9*b* and the second contact piece section 9*d*, can thus more reliably suppress the pivotal motion of the pin terminal T in the clockwise direction R2, whereby occurrence of plated film separation due to the minute sliding contact and other undesirably phenomena can be avoided.

In the movable connector 1, the long inter-contact distances L4 and L5 reliably suppress the pivotal motion of the pin terminal T at the first contact section 9*b*2 and the second contact section 9*d*2 (contact protrusion 9*d*3), which each serves as the center of the pivotal motion, but a short inter-contact distance L6 between the first contact section 9*b*2 and the second contact section 9*d*2 (contact protrusion 9*d*3) is achieved, as shown in FIG. 10, whereby an increase in the size of the contact section 9 is suppressed. That is, the contact surface section 9*c*1 is formed as a flat surface extending from a point close to the insertion port 3*e* to a point beyond the first contact section 9*b*2 and the second contact section 9*d*2 (contact protrusion 9*d*3) in the insertion direction of the pin terminals T (direction Z). The position where the pin terminal T comes into contact with the contact surface section 9*c*1 on the far side in the insertion direction when the pin terminal T pivots in the counterclockwise direction R1 can therefore be a farther position in the connection chamber 3*c* beyond the second contact section 9*d*2 (contact protrusion 9*d*3). Similarly, the position where the pin terminal T comes into contact with the contact surface section 9*c*1 on the side close to the insertion port 3*e* when the pin terminal T pivots in the clockwise direction R2 can be a position shifted toward the insertion port 3*e* beyond the first contact section 9*b*2. The pivotal motion of the pin terminal T can therefore be more reliably suppressed with a short inter-contact distance L6 and hence no increase in the size of the contact section 9.

The contact receiving section 9*c* has the fixing sections 9*c*2, which are formed at a front end portion located in a position close to the insertion port 3*e* in the connection chamber 3*c* and fixed to the movable housing 3. The contact receiving section 9*c* can therefore be reliably so fixed as not to protrude into the connection chamber 3*c*, whereby a situation in which the pin terminal T comes into contact with the front end portion of the contact receiving section 9*c* to cause buckling of the contact receiving section 9*c* can be avoided.

The first contact piece section 9*b* and the second contact piece section 9*d* are formed as spring pieces displaceable independently of each other. The first contact piece section 9*b* and the second contact piece section 9*d* can therefore each come into contact with the pin terminal T independently of the other without affecting the contact pressure, the contact position, and other contact states of the other with respect to the pin terminal T.

The second contact piece section 9*d* is configured as a part linked to the contact receiving section 9*c*. More specifically, the base end of the second elastic arm 9*d*1 is so formed as to be linked to the contact receiving section 9*c*, whereby an increase in the size of the contact section 9 is suppressed. That is, to form the second contact piece section 9*d* in such a way that it extends from the fixed base section 9*a* in parallel to the first contact piece section 9*b* in the same direction in which the first contact piece section 9*b* extends, the first contact section 9*b*2 and the second contact section 9*d*2 need to be positionally shifted from each other in the insertion direction of the pin terminals T (direction Z) to avoid interference between the first contact section 9*b*2 and the second contact section 9*d*2. In this case, the size of the contact section 9 undesirably increases in the insertion direction (direction Z). On the other hand, configuring the second contact piece section 9*d* as a part linked to the contact receiving section 9*c* allows reduction in the size of the second contact piece section 9*d* because the direction in which the first elastic arm 9*b*1 extends and direction in which the second elastic arm 9*d*1 extends does not coincide with each other but intersect each other, whereby the size of the contact section 9, which has a terminal structure having the two contact piece sections 9*b* and 9*d*, can be reduced.

The second elastic arm 9*d*1 is so formed as to link the plate edges 9*a*1 and 9*c*3 to each other, which are located on the side where the linkage section 9*f*, which links the fixed base section 9*a* to the contact receiving section 9*c*, is present, whereby the second elastic arm 9*d*1 and the linkage section 9*f* are disposed side by side on one side of the contact section 9. An increase in the size of the contact section 9 in the width direction (direction X) can therefore be suppressed, whereby the size of the movable connector 1 can be reduced.

The first contact section 9*b*2 protrudes beyond the contact protrusion 9*d*3 of the second contact section 9*d*2 toward the contact receiving section 9*c*. Therefore, when the pin terminal T is inserted, the pressing contact provided by the first contact section 9*b*2 presses the pin terminal T against the contact surface section 9*c*1 to achieve an appropriate insertion attitude of the pin terminal T along the flat surface of the contact surface section 9*c*1. In this state, the contact protrusion 9*d*3 can achieve pressing contact with the pin terminal T, whereby contact that causes buckling of the second contact section 9*d*2 can be avoided.

The first contact section 9*b*2 is formed in a convexly bent shape. The space above an inclining piece of the first contact section 9*b*2 or the inclining piece on the far side in the insertion direction therefore forms a dead space. In the movable connector 1, however, since the second contact section 9*d*2 is disposed in the space, the second contact section 9*d*2 does not protrude beyond the space between the first contact section 9*b*2 and the linkage section 9*f* and out of the contact section 9, whereby the size of the contact section 9 can be reduced, and the movable connector 1 can also be formed as to be compact.

Figure 11:
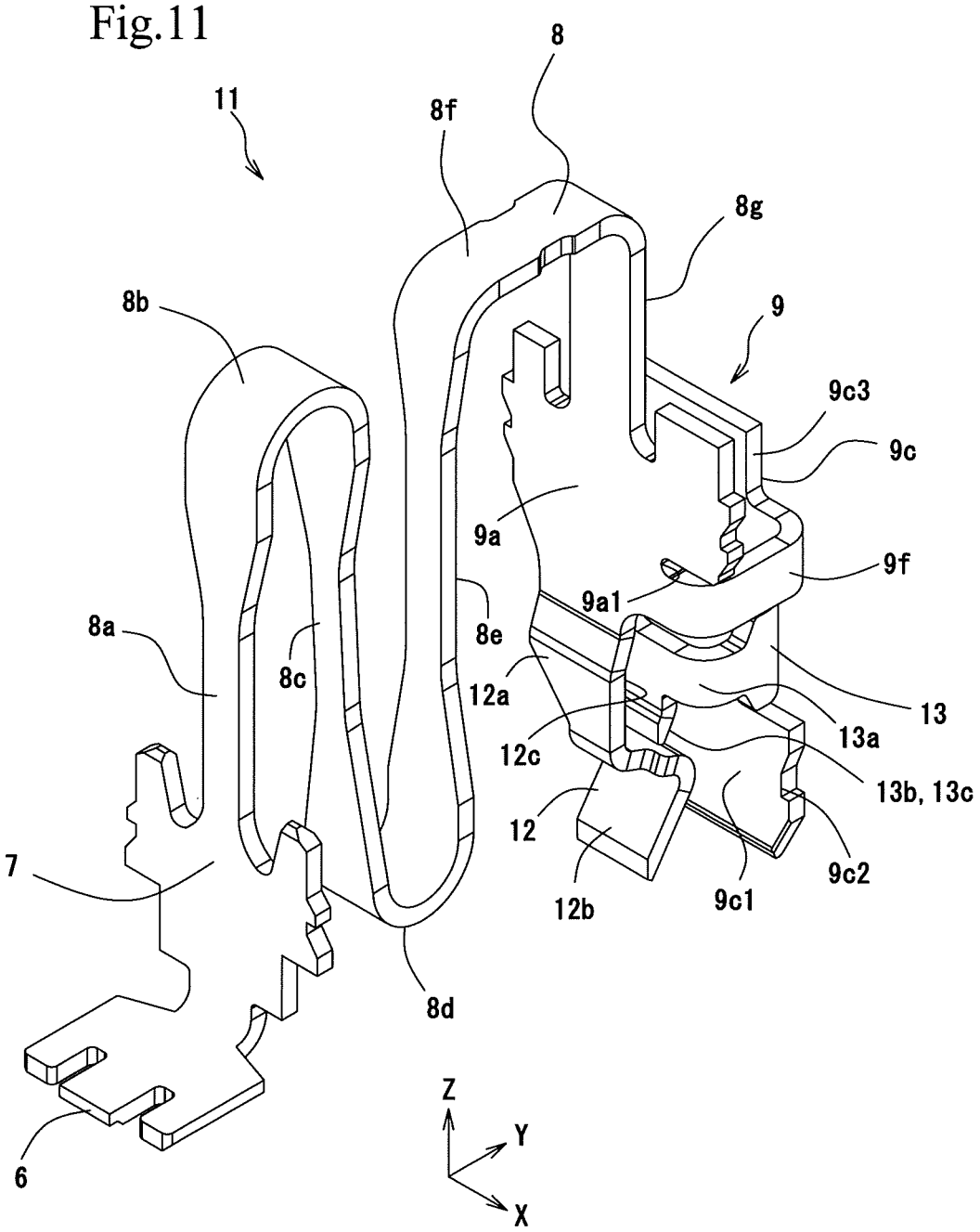
FIG. 11 is an exterior perspective view including the front surface, the right side surface, and the plan surface of a terminal provided in a movable connector according to a second embodiment.
Figure 12:
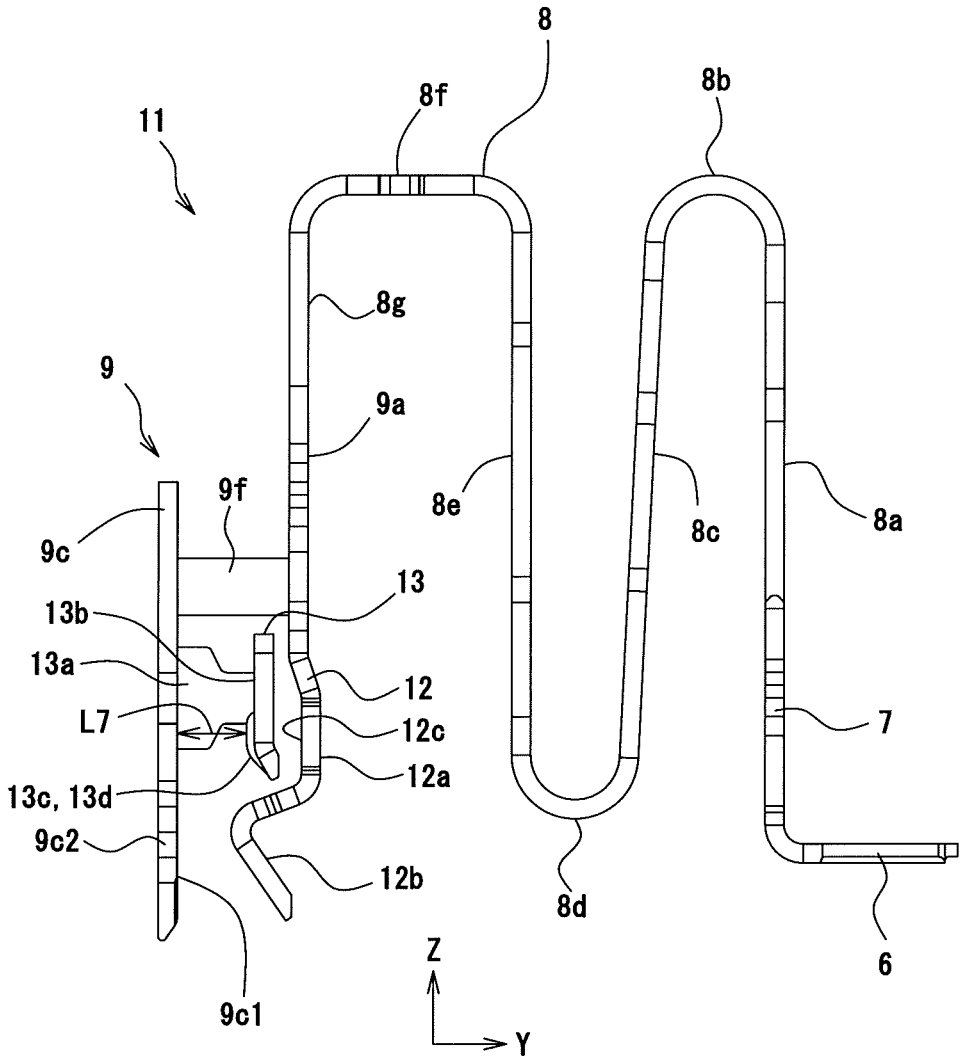
FIG. 12 is a left side view of the terminal shown in FIG. 11.
Figure 13:
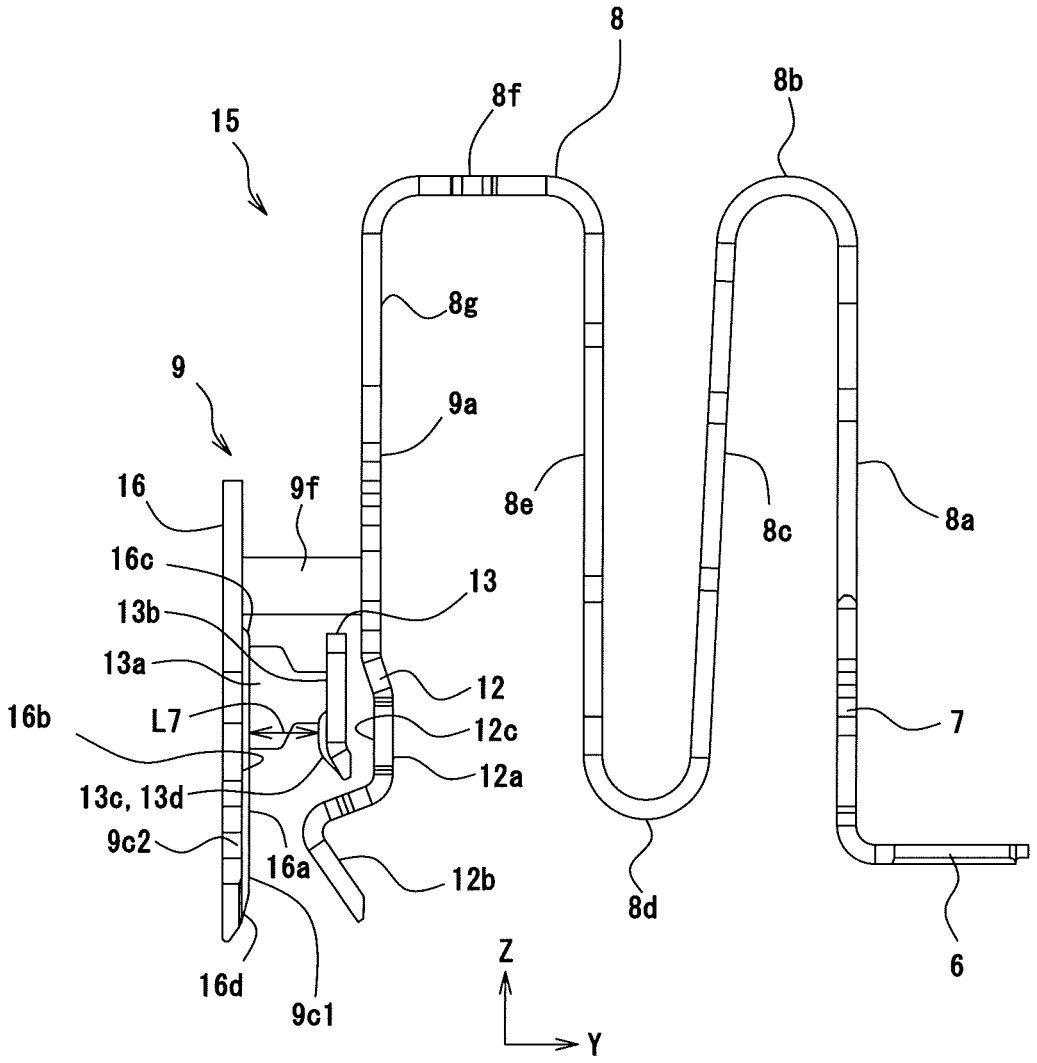
FIG. 13 is a left side view of a terminal provided in a movable connector according to a third embodiment.

Second Embodiment [FIGS. 11 to 12]

A movable connector according to a second embodiment differs from the movable connector 1 according to the first embodiment in terms of a first contact piece section 12 and a second contact piece section 13 of each of terminals 11, and the two movable connectors are the same in terms of the other configurations and advantageous effects based thereon. Only the differences will therefore be described, and the points common to those in the first embodiment will not be redundantly described.

The first contact piece section 12 has a first elastic arm 12*a* and a first contact section 12*b*, which is the same as the first contact section 9*b*2 in the first embodiment. Out of the two components that form the first contact piece section 12, the first elastic arm 12*a* has a clearance recess section 12*c*, which is formed in the middle of the first elastic arm 12*a* and bends and protrudes toward the side opposite the second contact piece section 13.

The second contact piece section 13 in the present embodiment has a second elastic arm 13*a* and a second contact section 13*b*. Out of the two components that form the second contact piece section 13, the second contact section 13*b* has a guiding inclining surface 13*c*, which guides the insertion of the pin terminal T, at a front end portion of the second contact section 13*b*. The second contact section 13*b* further has a contact protrusion 13*d* which seamlessly protrudes in the form of a bead from the guiding inclining surface 13*c*, and the contact protrusion 13*d* achieves pressing contact with the pin terminal T.

The movable connector including the thus configured terminals 11 in the second embodiment can provide the following advantageous effects in addition to the advantageous effects provided by the movable connector 1 according to the first embodiment.

First, the first elastic arm 12*a* has the clearance recess section 12*c*. Therefore, when the second contact section 13*b* achieves pressing contact with the pin terminal T and is therefore displaced toward the first elastic arm 12*a*, the second contact section 13*b* merely enters the clearance recess section 12*c* but does not come into contact with the first elastic arm 12*a*. The second contact section 13*b* can therefore achieve electrically continuous contact with the pin terminal T at predetermined contact pressure. In a case where no clearance recess section 12*c* is formed, the second contact section 13*b* needs to be further separate from the first contact piece section 12 so that the displaced second contact section 13*b* does not come into contact with the first elastic arm 12*a*. Specifically, the linkage section 9*f* shown in FIG. 12 needs to be further extended leftward in FIG. 12. In this case, the size of the terminals 11 and the size of the movable connector that includes the terminals 11 undesirably increase in the frontward/rearward direction Y. However, since the clearance recess section 12*c* can avoid the contact between the second contact section 13*b* and the first elastic arm 12*a*, the first elastic arm 12*a* and the second contact section 13*b* can be so disposed as to approach each other, whereby the terminals 11 and the movable connector can be so formed as to be compact.

The guiding inclining surface 13*c*, which guides the insertion of the pin terminal T, is formed at the front end portion of the second contact section 13*b*. Therefore, even when the pin terminal T is obliquely inserted and is therefore likely to go through the space between the front end of the second contact section 13*b* and the first contact section 12*b*, the pin terminal T abuts against the guiding inclining surface 13*c* and is therefore not allowed to enter the space.

Third Embodiment [FIGS. 13 to 15A and 15B]

A movable connector according to a third embodiment differs from the movable connector according to the second embodiment in terms of a contact receiving section 16 of each of terminals 15, and the two movable connectors are the same in terms of the other configurations and advantageous effects based thereon. Only the differences will therefore be described.

A contact surface section 16*a*, which protrudes toward the first contact section 12*b* and the second contact section 13*b*, is formed in a central portion of the contact receiving section 16 of each of the terminals 15. The contact surface section 16*a* is so formed as to be wider than the pin terminal T but narrower than the contact receiving section 16 in the width direction (direction X), and the contact surface section 16*a* is further so formed as to extend in the length direction (direction Z) from the front end of the contact receiving section 16 to a position between the second elastic arm 13*a* and the linkage section 9*f*. When the contact surface section 16*a* is taken as a "protruding portion" of the contact receiving section 16, the area around the contact surface section 16*a* is a flat general surface section 16*b*, which forms a "non-protruding portion" of the contact receiving section 16. The contact surface section 16*a* is formed of a bead-shaped "protrusion," and a side of the contact surface section 16*a* or the side opposite the side that comes into contact with the pin terminal T is a recess. The insertion gap L7, into which the pin terminal T is inserted, between the contact surface section 16*a* and the contact protrusion 13*d* of the second contact section 13*b* is set to be equal to the insertion gap L7, into which the pin terminal T is inserted, between the contact surface section 9*c*1 and the second contact section 13*b* in the second embodiment, so that the gap between the contact receiving section and the second contact piece section is greater in the third embodiment than in the second embodiment in the frontward/rearward direction (direction Y) by the length over which the contact surface section 16*a* protrudes.

Figure 14:
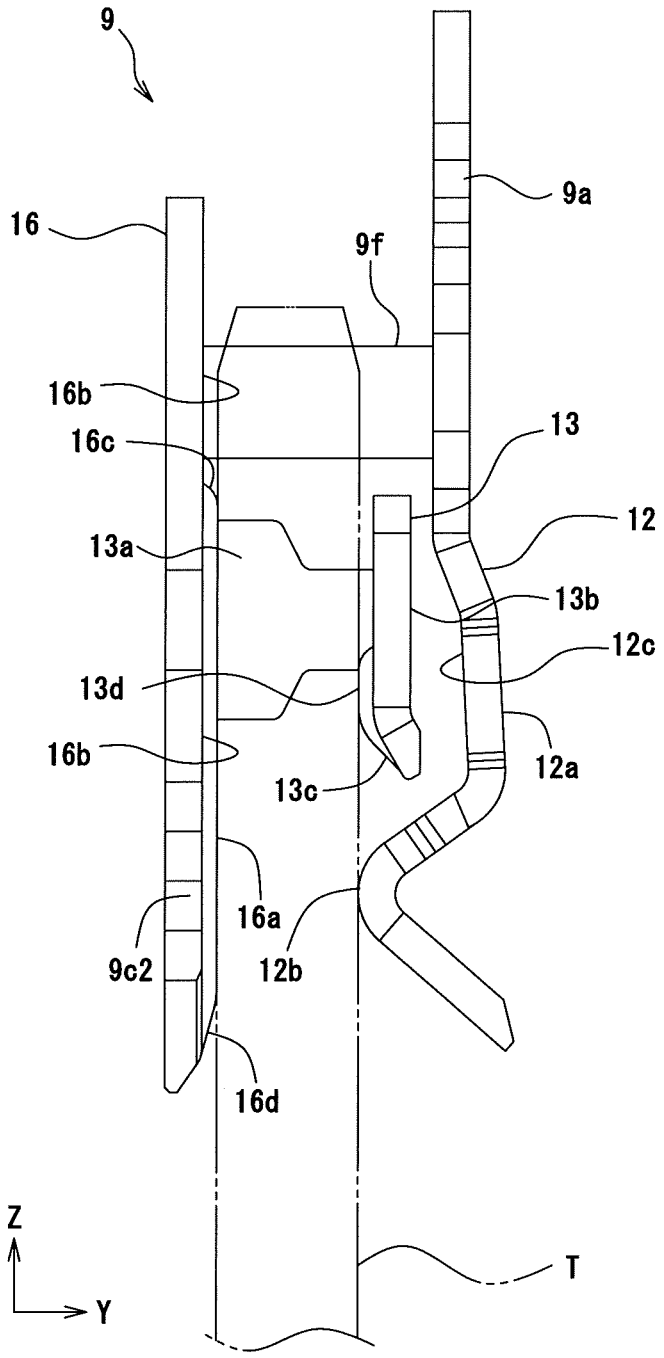
FIG. 14 is an enlarged view of a contact section of the terminal shown in FIG. 13.

FIG. 14 shows the state in which the pin terminal T is in contact with the contact surface section 16*a*. Steps 16*c* and 16*d* are formed at one end and the other end of the contact surface section 16*a*, respectively, in the insertion direction of the pin terminals T. Therefore, in the fitting connection state in which the pin terminal T is fitted and connected to the contact section 9, the pin terminal T is not in contact with but separate from the general surface section 16*b*, which is lower than the contact surface section 16*a*, and the pin terminal T is in contact only with the contact surface section 16*a*.

Figure 15A:
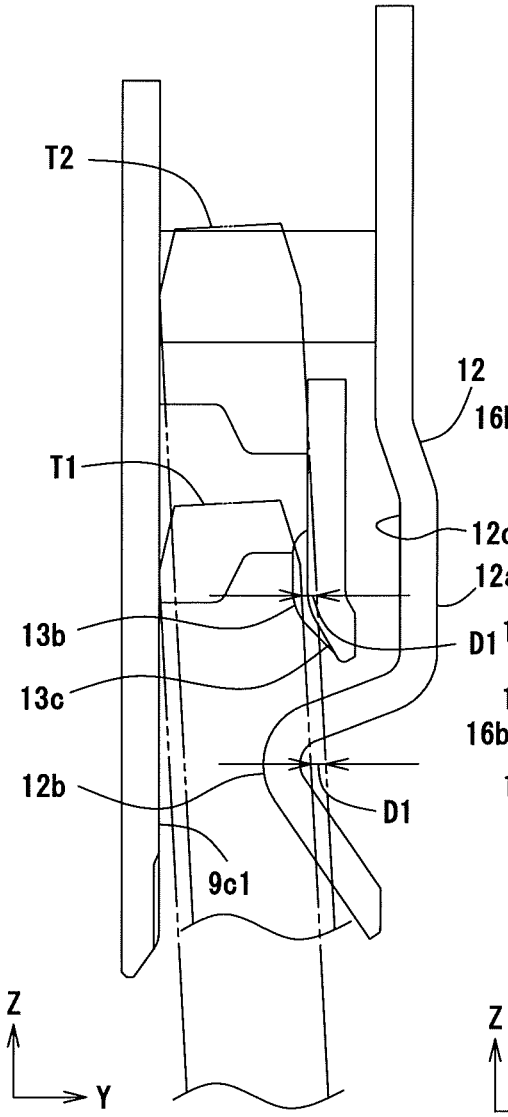
FIGS. 15A and 15B describe the action of the terminal shown in FIG. 13, FIG. 15A describing the action of the terminal in the second embodiment described with reference to FIG. 11, and FIG. 15B describing the action of the terminal in the third embodiment described with reference to FIG. 13.
Figure 15B:
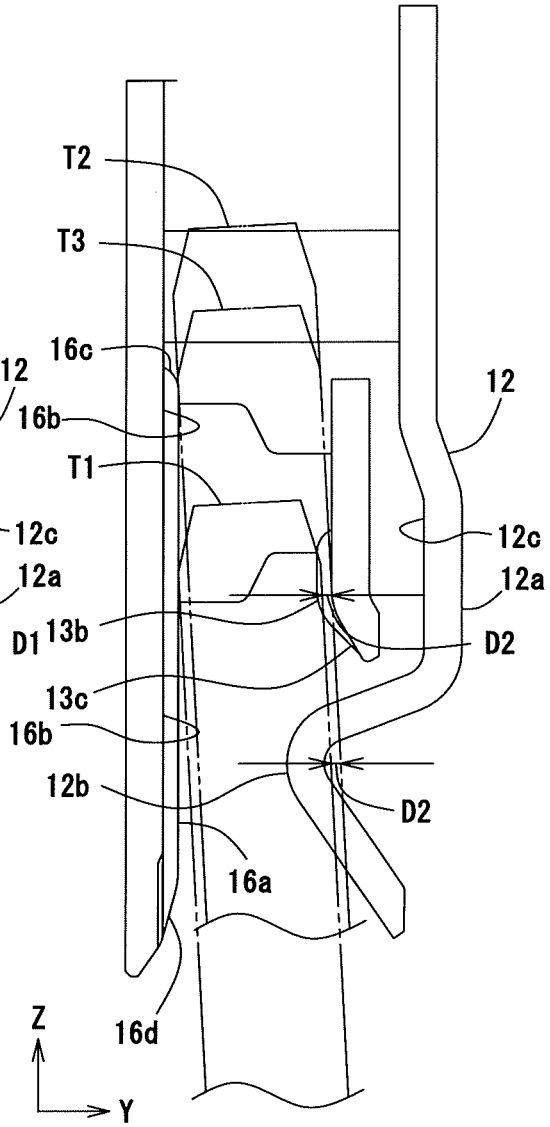

The thus configured contact surface section 16*a* provides the following advantage over the second embodiment: In the second embodiment, the contact surface section 9*c*1 is a flat surface, and when the insertion length of the pin terminal T varies and the pin terminal T is obliquely inserted, the amount of displacement of the first contact section 12*b* and the amount of displacement of the second contact section 13*b* differs from each other by a difference D1, as shown in FIG. 15A. That is, the amounts of displacement of the first contact section 12*b* and the second contact section 13*b* produced by a pin terminal T1, which is inserted by a smaller length, are smaller than the amounts of displacement produced by a pin terminal T2, which is inserted by a greater length, and the greater the insertion length is, the greater the difference D1 in the amount of displacement is. The difference D1 in the amount of displacement is reflected in the difference in the contact pressure acting on the pin terminal T, and the greater the difference D1 in the amount of displacement is, the higher the difference in the contact pressure is. Therefore, in the second embodiment, the contact pressure at each of the first contact section 12*b* and the second contact section 13*b* undesirably depends on the insertion length of the pin terminal T, so that the contact pressure cannot be controlled by the terminal 15 itself. Therefore, in a case where pressing contact provided at specific contact pressure needs to be performed on the pin terminal T, fitting connection based on a precise insertion length of the pin terminal T is required.

In contrast, in the case where the contact surface section 16*a*, which protrudes from the general surface section 16*b*, is provided, no management of the fitting connection achieved by a precise insertion length of the pin terminal T is required. That is, the pin terminal T1 shown in FIG. 15B indicates an insertion position that minimizes the insertion length (effective fitting length) that allows electrically continuous contact with the first contact section 12*b* and the second contact section 13*b*. The pin terminal T2 indicates an insertion position that provides an insertion length that allows electrically continuous contact with the first contact section 12*b* and the second contact section 13*b* and causes the front end of the pin terminal T2 to be located beyond the upper end of the contact surface section 16*a*, and this insertion position is a normal contact position. Even when the pin terminal T1 and the pin terminal T2 differ from each other in terms of the insertion length, a difference D2 in the amount of displacement between the first contact section 12*b* and the second contact section 13*b* can be reduced as compared with the case shown in FIG. 15A. In particular, a pin terminal T3 indicates an insertion position where the front end of the pin terminal T3 comes into contact with the contact surface section 16*a* in a position before the step 16*c* at the upper end of the contact surface section 16*a*, and the pin terminal T3 and the pin terminal T2, which is so inserted as to be located beyond the step 16*c*, produce the same amounts of displacement of the first contact section 12*b* and the second contact section 13*b*, and the contact pressure is therefore the same. The contact pressure produced by the first contact section 12*b* and the second contact section 13*b* can therefore be controlled by the terminal 15 itself irrespective of the insertion length of the pin terminal T.

Figure 16:
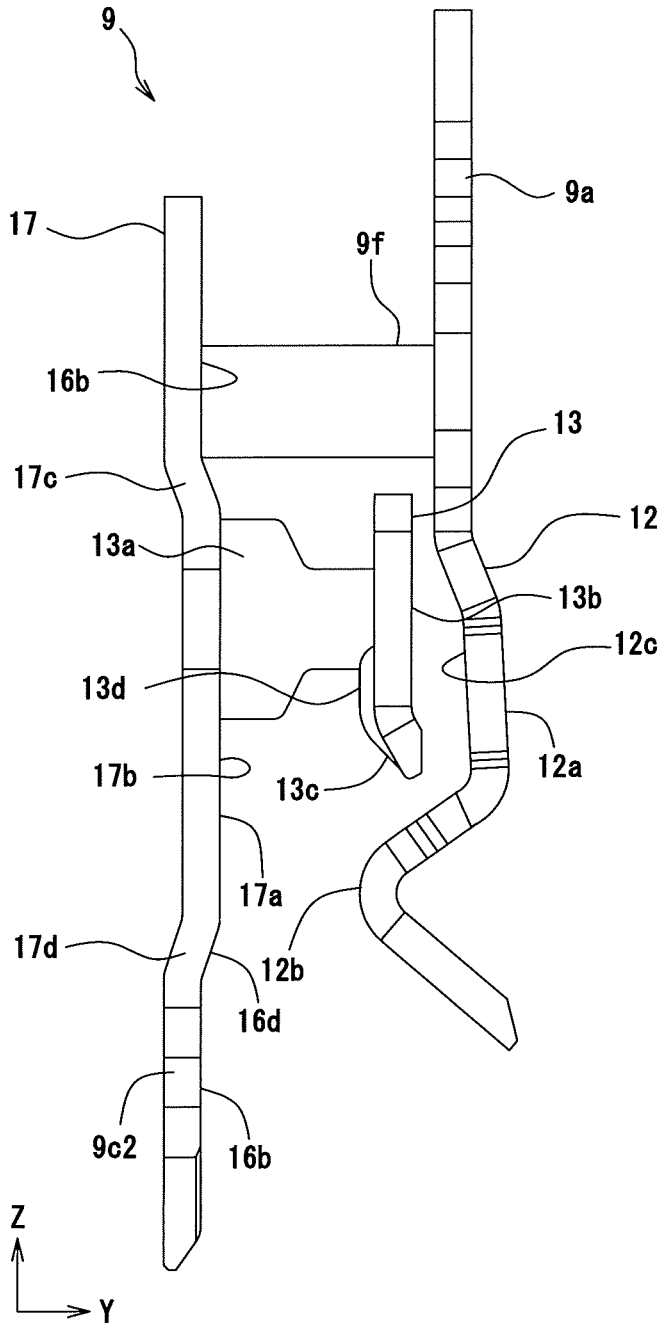
FIG. 16 is an enlarged view of a contact section according to a variation of the terminal shown in FIG. 13.

Variation of Third Embodiment [FIG. 16]

The contact receiving section 16 in the third embodiment described above can be replaced with a contact receiving section 17 in a variation shown in FIG. 16. The contact receiving section 17 has a contact surface section 17*a*, which protrudes toward the first contact section 12*b* and the second contact section 13*b*. The contact surface section 17*a* is formed of a protruding surface section 17*b*, a first bent section 17*c*, and a second bent section 17*d*. The contact surface section 17*a*, which provides the same advantageous effect provided by the contact surface section 16*a* in the third embodiment, can be provided by bending an electrically conductive plate that is the raw material of the contact receiving section 17. That is, when the pin terminal T is inserted to a point beyond the first bent section 17*c*, the contact pressure produced by the first contact section 12*b* and the second contact section 13*b* can be controlled to be a fixed value by the terminal 15 itself irrespective of the insertion length of the pin terminal T.

To employ the contact surface section 17*a*, the first bent section 17*c* needs to be formed in a position between the second elastic arm 13*a* and the linkage section 9*f*, and the second bent section 17*d* needs to be formed in a position closer to the front end of the contact receiving section 17 than the first contact section 12*b*. Further, since the fixing sections 9*c*2 need to be provided in a position closer to the front end of the contact receiving section 17 than the second bent section 17*d*, the contact receiving section 17 in the variation is undesirably longer than the contact receiving section 16 in the third embodiment. Conversely, the contact receiving section 16 having the bead-shaped contact surface section 16*a* can be so formed to be shorter than the contact receiving section 17 in the variation, in which the contact surface section 17*a* is caused to protrude by bending a raw material, and is therefore advantageous in that the size of the terminals 15 can be reduced and the size of the movable connector that includes the terminals 15 can be reduced.

Figure 17:
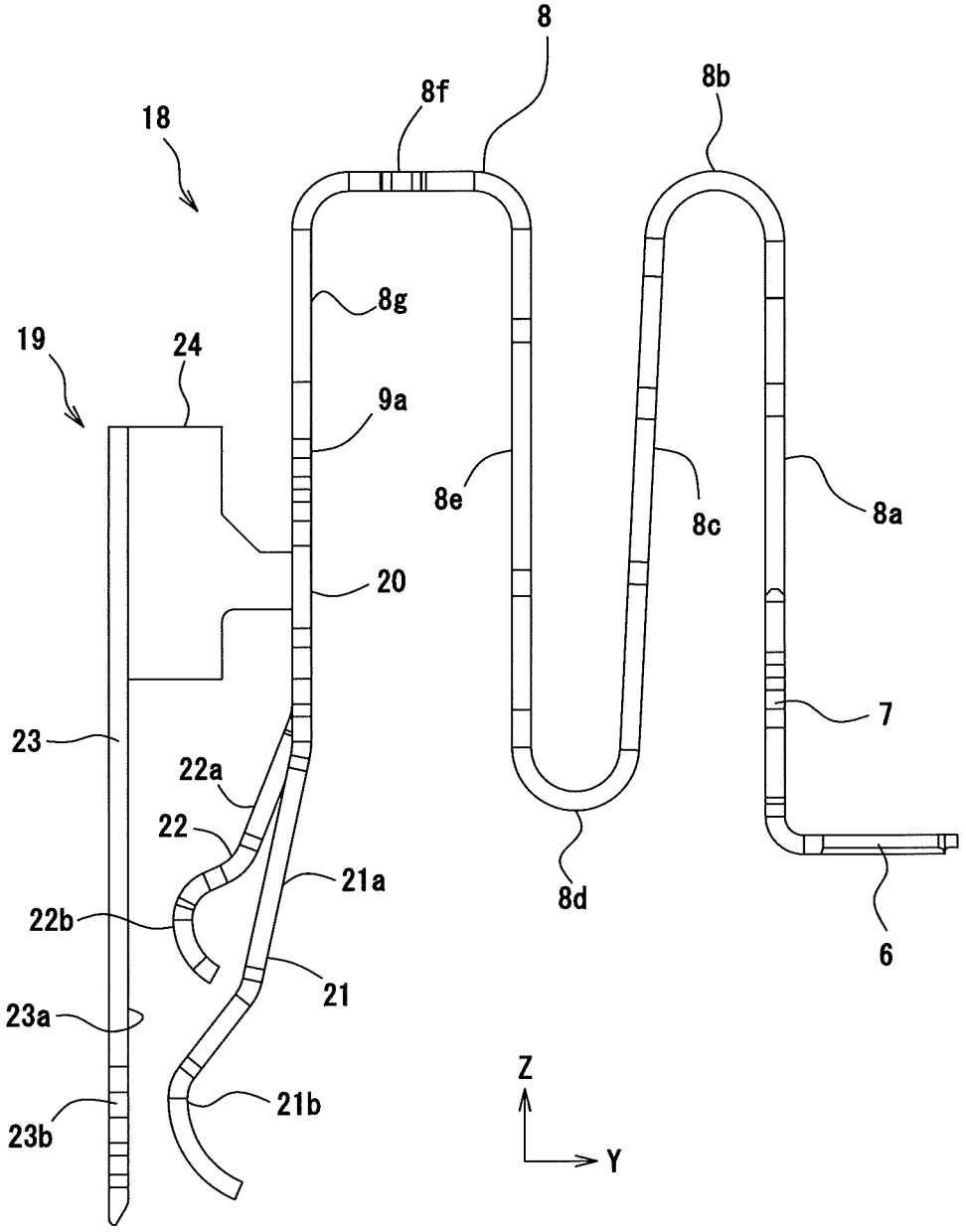
FIG. 17 is a left side view of a terminal provided in a movable connector according to a fourth embodiment.
Figure 18:
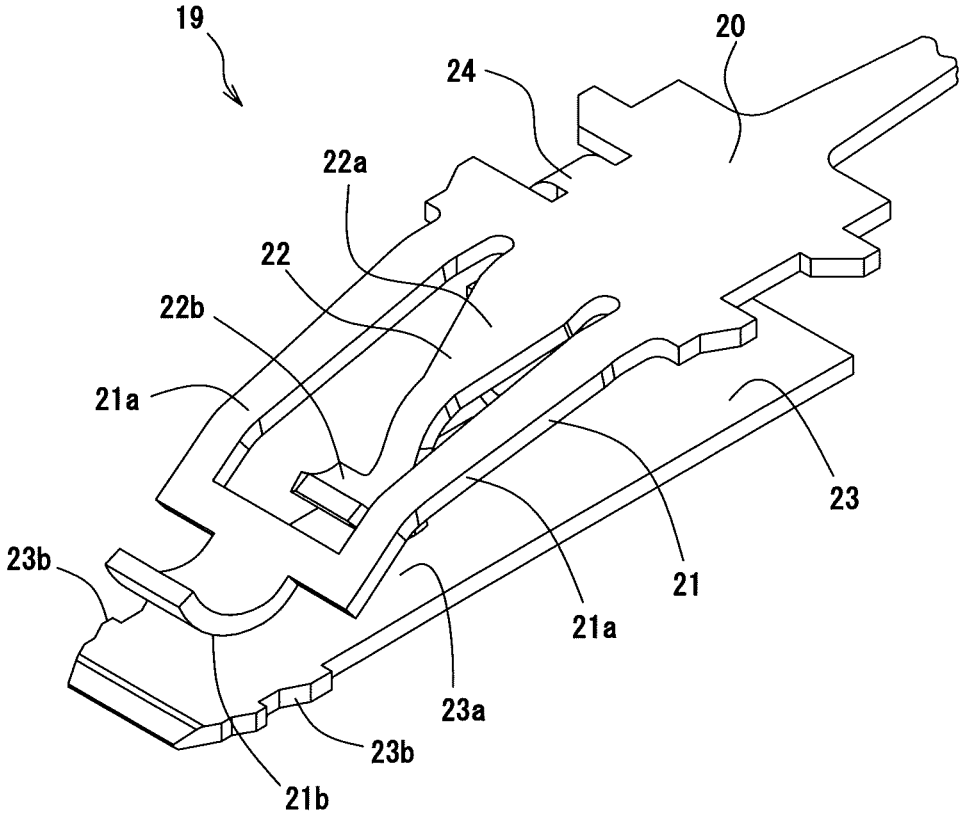
FIG. 18 is an enlarged view of a contact section of the terminal shown in FIG. 17.

Fourth Embodiment [FIGS. 17 and 18]

A movable connector according to a fourth embodiment differs from the movable connector 1 according to the first embodiment in terms of a contact section 19 of each of terminals 18, and the two movable connectors are the same in terms of the other configurations and advantageous effects based thereon. Only the difference will therefore be described.

The contact section 19 is formed of a fixed base section 20, a first contact piece section 21, a second contact piece section 22, a contact receiving section 23, and a linkage section 24, which links the fixed base section 20 to the contact receiving section 23. The second contact piece section 22 is so formed as to extend from the fixed base section 20, as with the first contact piece section 21. The first contact piece section 21 has two first elastic arms 21*a*, which extend from the fixed base section 20 in parallel to each other, and a first contact section 21*b*, which has a convexly bent shape and is formed at the front ends of the first elastic arms 21*a*. The second contact piece section 22 has a second elastic arm 22*a*, which is located between the two first elastic arms 21*a*, and a second contact section 22*b*, which has a convexly bent shape and is displaceably supported by the second elastic arm 22*a*.

The contact receiving section 23, which is so located as to face the first contact piece section 21 and the second contact piece section 22, is formed in a flat-plate-like shape, as with the contact receiving section 9*c* in the first embodiment, and has a flat contact surface section 23*a*. Since the first contact piece section 21 and the second contact piece section 22 both extend from the fixed base section 20, the contact receiving section 23 is formed accordingly so as to be longer than the contact receiving section 9*c* in the first embodiment. Conversely, the contact receiving section 9*c*, the terminals 4 each having the contact receiving section 9*c*, and the movable connector 1 in the first embodiment are superior to those in the fourth embodiment in terms of compactness in the insertion direction of the pin terminals T (direction Z). Fixing sections 23*b*, which are fixed to the movable housing 3, are formed at a front end portion of the contact receiving section 23.

The present embodiment employs the structure in which the first contact piece section 21 and the second contact piece section 22 extend as spring pieces from the common fixed base section 20 in parallel to each other, so that not only the first elastic arms 21*a* but the second elastic arm 22*a* can be so formed as to be longer than those in the first embodiment. Therefore, the elastic arms 21*a* and 22*a* can follow pivotal motion of the pin terminal T and can be flexibly displaced accordingly, whereby a satisfactory state of the contact of the first contact section 21*b* and the second contact section 22*b* with the pin terminal T can be maintained. Further, since the second contact section 22*b* is formed in the form of a rolled surface, the resistance produced when the pin terminal T is inserted decreases, whereby the durability of the pin terminal T repeatedly inserted and extracted can be increased.

Figure 19:
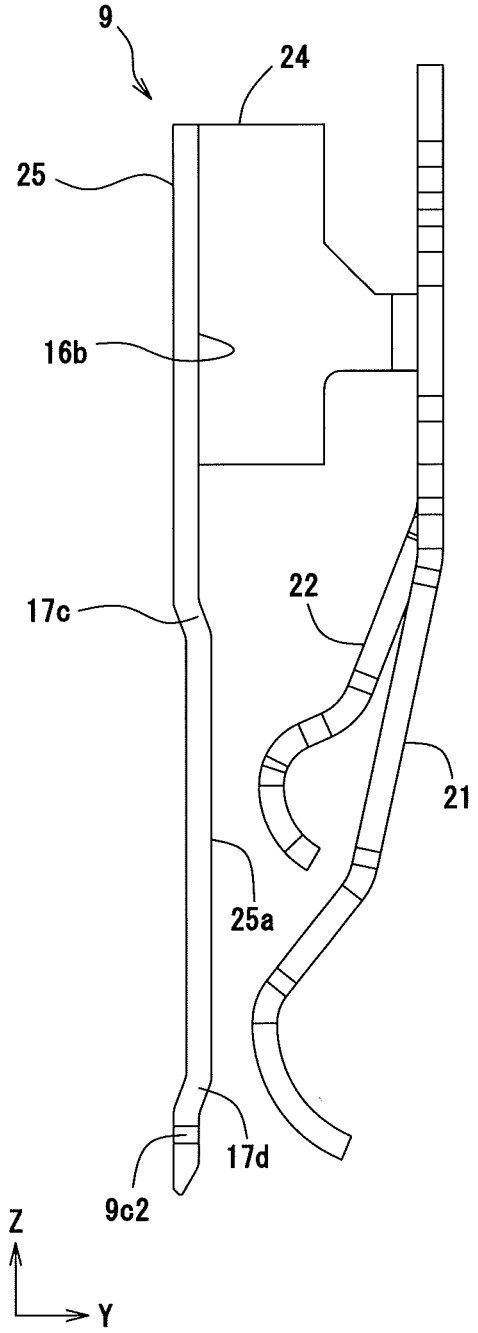
FIG. 19 is an enlarged view of a contact section according to a variation of the terminal shown in FIG. 17.

Variation of Fourth Embodiment [FIG. 19]

The contact receiving section 23 of the fourth embodiment can be replaced with a contact receiving section 25 in FIG. 19. The contact receiving section 25 has a contact surface section 25*a*, which is the same as the contact surface section in the variation of the third embodiment shown in FIG. 16. The contact surface section 17*a*, which provides the same advantageous effect as with the third embodiment, can be provided by bending an electrically conductive plate that is the raw material of the contact receiving section 25. The contact surface section 17*a* according to the variation of the third embodiment can be replaced with the contact surface section 16*a*, which protrudes in the form of bead, in the third embodiment.

What is claimed is:

1. A movable connector comprising:

a first housing;

a second housing; and a terminal having a movable section that supports the second housing in such a way that the second housing is displaceable relative to the first housing and a contact section that achieves electrically continuous contact with a connection target object, wherein the contact section includes a first contact piece section having a first contact section that achieves pressing contact with the connection target object in a first direction, the first contact section being located only in a first position, a second contact piece section having a second contact section that achieves pressing contact with the connection target object in the first direction, the second contact section being located only in a second position which is different from the first position with respect to the insertion direction of the connection target object, wherein the second contact section is shifted from the first contact section at a rear side with respect to the insertion direction of the connection target object so that the first contact section is arranged to contact the connection target object prior to the second contact section in the insertion direction of the connection target object upon insertion of the connection target object, and a contact receiving section that faces the first contact section and the second contact section and has a contact surface section that comes into contact with the connection target object along the connection target object, wherein the first contact piece section and the second contact piece section are formed as spring pieces.

2. A movable connector comprising:

a first housing;

a second housing including a connection chamber having an insertion port through which a connection target object is inserted; and a terminal having a movable section that supports the second housing in such a way that the second housing is displaceable relative to the first housing and a contact section that achieves electrically continuous contact with the connection target object in the connection chamber, wherein the contact section includes a first contact piece section having a first contact section that achieves pressing contact with the connection target object in a first direction, the first contact section being located only in a first position which is close to the insertion port in the connection chamber, a second contact piece section having a second contact section that achieves pressing contact with the connection target object in the first direction, the second contact section being located only in a second position which is shifted from the first contact section toward a far side, in the connection chamber, with respect to the insertion direction of the connection target object so that the first contact section is arranged to contact the connection target object prior to the second contact section in the insertion direction of the connection target object upon insertion of the connection target object, and a contact receiving section that faces the first contact section and the second contact section in the connection chamber and has a contact surface section that comes into contact with the connection target object inserted into the connection chamber along the connection target object, wherein the first contact piece section and the second contact piece section are formed as spring pieces.

3. The movable connector according to claim 2, wherein the contact receiving section has a fixing section fixed to the second housing, the fixing section located at a front end portion located in a position close to the insertion port.

4. The movable connector according to claim 2, wherein the first contact piece section and the second contact piece section are formed as spring pieces displaceable independently of each other.

5. The movable connector according to claim 2, wherein the second contact piece section has a second elastic arm that supports the second contact section in such a way that the second contact section is displaceable relative to the contact receiving section.

6. The movable connector according to claim 5, wherein the second elastic arm is so shaped as to link opposing plate edges of the second contact section and the contact receiving section to each other.

7. The movable connector according to claim 2, wherein the second contact section has a guiding inclining surface that guides the insertion of the connection target object, the guiding inclining surface located at a front end portion close to the insertion port.

8. The movable connector according to claim 2, wherein the first contact section has a convexly bent shape located in a position closer to the insertion port than the second contact section.

9. The movable connector according to claim 2, wherein the first contact piece section has a clearance recess section that avoids contact with the second contact section displaced toward the first contact piece section when the second contact section receives the pressing contact produced by the connection target object.

10. The movable connector according to claim 2, wherein the contact surface section is so shaped as to protrude toward the first contact section and the second contact section.

11. The movable connector according to claim 10, wherein the contact surface section is a protrusion that protrudes in the form of a bead toward the first contact section and the second contact section.

12. The movable connector according to claim 10, wherein the contact surface section is a protruding surface section so configured that at least the contact receiving section, which faces the first contact section and the second contact section, protrudes toward the first contact section and the second contact section.

* * * * *